US010343017B2

(12) United States Patent
Jackson

(10) Patent No.: US 10,343,017 B2
(45) Date of Patent: Jul. 9, 2019

(54) DISTANCE SENSOR FOR CONSOLE POSITIONING

(71) Applicant: ICON Health & Fitness, Inc., Logan, UT (US)

(72) Inventor: Spencer Scott Jackson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 4 days.

(21) Appl. No.: 15/787,442

(22) Filed: Oct. 18, 2017

(65) Prior Publication Data

US 2018/0117419 A1 May 3, 2018

Related U.S. Application Data

(60) Provisional application No. 62/415,898, filed on Nov. 1, 2016.

(51) Int. Cl.
*A63B 22/00* (2006.01)
*A63B 24/00* (2006.01)
(Continued)

(52) U.S. Cl.
CPC ..... *A63B 24/0087* (2013.01); *A63B 22/0023* (2013.01); *A63B 22/025* (2015.10); *A63B 71/0622* (2013.01); *A63B 24/0075* (2013.01); *A63B 2071/0658* (2013.01); *A63B 2220/16* (2013.01); *A63B 2220/20* (2013.01); *A63B 2220/62* (2013.01); *A63B 2220/80* (2013.01); *A63B 2220/805* (2013.01); *A63B 2220/806* (2013.01); *A63B 2220/808* (2013.01);
(Continued)

(58) Field of Classification Search
None
See application file for complete search history.

(56) References Cited

U.S. PATENT DOCUMENTS 232,022 A 9/1880 Gifford
284,294 A 9/1883 Graves
(Continued)

FOREIGN PATENT DOCUMENTS

CN 204337631 5/2015
CN 105797307 7/2016
(Continued)

OTHER PUBLICATIONS

International Search Report and Written Opinion issued in PCT/US2017/057443 dated Feb. 28, 2018.
(Continued)

*Primary Examiner* — Stephen R Crow
(74) *Attorney, Agent, or Firm* — Ray Quinney & Nebeker

(57) ABSTRACT

A treadmill includes an exercise deck. The exercise deck includes a platform, a first pulley incorporated into the platform at a front end, a second pulley incorporated into the platform at a rear end, a tread belt surrounding the first pulley and the second pulley, and multiple tilt actuators incorporated into the platform. The treadmill also includes an upright structure. The upright structure includes a console, a tilt controller incorporated into the console in communication with the multiple tilt actuators, and the tilt controller having a two dimensional input mechanism.

20 Claims, 5 Drawing Sheets

(51) Int. Cl.
*A63B 22/02* (2006.01)
*A63B 71/06* (2006.01)

(52) U.S. Cl.
CPC ... *A63B 2220/833* (2013.01); *A63B 2220/836* (2013.01); *A63B 2220/89* (2013.01); *A63B 2225/093* (2013.01); *A63B 2225/54* (2013.01); *A63B 2230/06* (2013.01); *A63B 2230/75* (2013.01)

(56) References Cited

U.S. PATENT DOCUMENTS 321,388 A 6/1885 Ruebsam
339,638 A 4/1886 Goldie
421,779 A 2/1890 Steven
447,780 A 3/1891 Luge
450,792 A 4/1891 Dodd
659,216 A 10/1900 Dowling
663,486 A 12/1900 Boren
674,391 A 5/1901 Baker
683,284 A 9/1901 Honey
766,930 A 8/1904 De Laski
881,521 A 3/1908 Wilson
897,722 A 9/1908 Day
931,394 A 8/1909 Day
937,795 A 10/1909 Hackney
1,016,729 A 2/1912 Barrett
1,020,777 A 3/1912 Peterson
1,064,968 A 6/1913 Hagen
1,082,940 A 12/1913 Flora
1,211,765 A 1/1917 Schmidt
1,570,482 A 1/1926 Hale
1,580,530 A 4/1926 Rambo
1,585,748 A 5/1926 Wendelken
1,715,870 A 6/1929 Augustine
1,766,089 A 6/1930 Wood
1,778,635 A 10/1930 Heisler
1,824,406 A 9/1931 Petersime
1,850,530 A 3/1932 Brown
1,893,728 A 1/1933 Bullis
1,902,694 A 3/1933 Edwards
1,919,627 A 7/1933 FitzGerald
1,928,089 A 9/1933 Blickman
1,973,945 A 9/1934 Chavin
1,978,579 A 10/1934 Hooks
1,982,843 A 12/1934 Traver
2,067,136 A 1/1937 Bridenbaugh
2,117,957 A 5/1938 Ritter
2,165,700 A 7/1939 Henry
2,177,957 A 10/1939 Stewart
2,219,219 A 10/1940 Boger
2,247,946 A 7/1941 Hein et al.
2,255,864 A 9/1941 Stephens
2,315,485 A 4/1943 Le Roy
2,399,915 A 5/1946 Drake
2,440,644 A 4/1948 Powell
2,569,007 A 9/1951 Klyce
2,607,816 A 8/1952 Ryder
2,632,645 A 3/1953 Barkschat
2,645,539 A 7/1953 Thompson
2,646,282 A 7/1953 Ringman
2,648,540 A 8/1953 Hunter
2,674,453 A 4/1954 Hummert
2,743,623 A 5/1956 Wells
2,746,822 A 5/1956 Copenhaver
2,842,365 A 7/1958 Kelley
2,855,200 A 10/1958 Blickman
2,874,971 A 2/1959 Devery
2,969,060 A 1/1961 Swanda
2,984,594 A 5/1961 Runton
3,035,671 A 5/1962 Sicherman
3,059,312 A 10/1962 Jamieson
3,068,950 A 12/1962 Davidson
3,072,426 A 1/1963 Gilbert
3,112,108 A 11/1963 Hanke
3,127,171 A 3/1964 Noland et al.
3,179,071 A 4/1965 Johnston
3,193,287 A 7/1965 Robinson
3,205,888 A 9/1965 Stroop
3,316,898 A 5/1967 Brown
3,319,273 A 5/1967 Lawrence
3,342,485 A 9/1967 Martin
3,345,067 A 10/1967 Smith
3,358,813 A 12/1967 Kohlhagen
3,368,746 A 2/1968 Zelinski
3,378,259 A 4/1968 Kupchinski
3,408,067 A 10/1968 Armstrong
3,408,069 A 10/1968 Lewis
3,411,497 A 11/1968 Rickey et al.
3,416,174 A 12/1968 Novitske
3,430,084 A 2/1969 Hall
3,430,507 A 3/1969 Hurst et al.
3,438,627 A 4/1969 La Lanne
3,444,830 A 5/1969 Doetsch
3,446,503 A 5/1969 Lawton
3,501,140 A 3/1970 Eichorn
3,511,500 A 5/1970 Dunn
3,514,110 A 5/1970 Thomander
3,518,985 A 7/1970 Quinton
3,522,947 A 8/1970 Anderson
3,547,435 A 12/1970 Scott
3,554,541 A 1/1971 Spoth
3,563,541 A 2/1971 Sanquist
3,566,861 A 3/1971 Weiss
3,567,219 A 3/1971 Foster
3,568,669 A 3/1971 Stites
3,572,700 A 3/1971 Mastropaolo
3,583,465 A 6/1971 Youngs et al.
3,586,322 A 6/1971 Kverneland
3,589,715 A 6/1971 Mark
3,592,466 A 7/1971 Parsons
3,598,404 A 8/1971 Bowman
3,602,502 A 8/1971 Jaegar
3,606,320 A 9/1971 Erwin, Jr.
3,608,898 A 9/1971 Berlin
3,614,097 A 10/1971 Blickman
3,628,654 A 12/1971 Haracz
3,628,791 A 12/1971 Garcia
3,634,895 A 1/1972 Childers
3,636,577 A 1/1972 Nissen
3,638,941 A 2/1972 Kulkens
3,640,528 A 2/1972 Proctor
3,641,601 A 2/1972 Sieg
3,642,279 A 2/1972 Cutter
3,643,943 A 2/1972 Erwin, Jr. et al.
3,650,529 A 3/1972 Salm
3,658,327 A 4/1972 Thiede
3,659,845 A 5/1972 Quinton
3,664,666 A 5/1972 Lloyd
3,686,776 A 8/1972 Dahl
3,689,066 A 9/1972 Hagen
3,703,284 A 11/1972 Hesen
3,708,166 A 1/1973 Annas
3,709,197 A 1/1973 Moseley
3,731,917 A 5/1973 Townsend
3,738,649 A 6/1973 Miller
3,741,538 A 6/1973 Useldinger
3,751,033 A 8/1973 Rosenthal
3,756,595 A 9/1973 Hague
3,767,195 A 10/1973 Dimick
3,788,412 A 1/1974 Vincent
3,792,860 A 2/1974 Selnes
3,809,393 A 5/1974 Jones
3,814,420 A 6/1974 Encke
3,822,488 A 7/1974 Johnson
3,826,491 A 7/1974 Elder
3,848,467 A 11/1974 Flavell
3,851,874 A 12/1974 Wilkin
3,858,938 A 1/1975 Kristensson et al.
3,861,215 A 1/1975 Bradley
3,869,121 A 3/1975 Flavell
3,870,297 A 3/1975 Elder
3,874,657 A 4/1975 Niebojewski
3,880,274 A 4/1975 Bechtloff

(56) References Cited

U.S. PATENT DOCUMENTS 3,883,922 A 5/1975 Fleischhauer
3,892,404 A 7/1975 Martucci
3,901,379 A 8/1975 Bruhm
3,903,613 A 9/1975 Bisberg
3,904,196 A 9/1975 Berlin
3,909,857 A 10/1975 Herrera
3,912,263 A 10/1975 Yatso
3,918,710 A 11/1975 Niebojewski
3,926,430 A 12/1975 Good
3,929,026 A 12/1975 Hofmann
3,938,400 A 2/1976 Konyha
3,941,377 A 3/1976 Lie
3,948,513 A 4/1976 Pfotenhauer
3,963,101 A 6/1976 Stadelmann et al.
3,977,451 A 8/1976 Duba
3,981,500 A 9/1976 Ryan
4,012,015 A 3/1977 Nelson et al.
4,024,949 A 5/1977 Kleysteuber et al.
4,026,545 A 5/1977 Schonenberger
4,033,567 A 7/1977 Lipfert
4,056,265 A 11/1977 Ide
4,063,726 A 12/1977 Wilson
4,063,727 A 12/1977 Hall
4,066,257 A 1/1978 Moller
4,066,259 A 1/1978 Brentham
4,067,372 A 1/1978 Masson
4,072,309 A 2/1978 Wilson
4,074,903 A 2/1978 Diez de Aux
4,077,626 A 3/1978 Newman
4,082,267 A 4/1978 Flavell
4,093,196 A 6/1978 Bauer
4,094,330 A 6/1978 Jong
4,111,417 A 9/1978 Gardner
4,113,071 A 9/1978 Muller et al.
4,120,294 A 10/1978 Wolfe
4,141,158 A 2/1979 Benseler et al.
4,146,222 A 3/1979 Hribar
4,149,714 A 4/1979 Lambert, Jr.
4,151,988 A 5/1979 Nabinger
4,151,994 A 5/1979 Stalberger, Jr.
4,161,998 A 7/1979 Trimble
4,167,938 A 9/1979 Remih
4,168,061 A 9/1979 Gordon
4,171,805 A 10/1979 Abbott
4,179,134 A 12/1979 Atkinson
4,183,156 A 1/1980 Rudy
4,183,494 A 1/1980 Cleveland
4,188,030 A 2/1980 Hooper
4,199,139 A 4/1980 Mahnke
4,204,673 A 5/1980 Speer, Sr.
4,208,049 A 6/1980 Wilson
4,215,516 A 8/1980 Huschle et al.
4,216,856 A 8/1980 Moring et al.
4,227,689 A 10/1980 Keiser
4,235,437 A 11/1980 Ruis et al.
4,240,627 A 12/1980 Brentham
4,248,476 A 2/1981 Phelps
4,249,725 A 2/1981 Mattox
4,251,932 A 2/1981 Love
4,253,661 A 3/1981 Russell
4,258,821 A 3/1981 Wendt
4,258,913 A 3/1981 Brentham
4,274,625 A 6/1981 Gaetano
4,278,095 A 7/1981 Lapeyre
4,278,249 A 7/1981 Forrest
4,286,782 A 9/1981 Fuhrhop
4,290,601 A 9/1981 Mittelstadt
4,300,761 A 11/1981 Howard
4,313,602 A 2/1982 Sullivan
4,313,603 A 2/1982 Simjian
4,324,501 A 4/1982 Herbenar
4,333,978 A 6/1982 Kocher
4,334,676 A 6/1982 Schonenberger
4,334,695 A 6/1982 Ashby
4,337,283 A 6/1982 Haas, Jr.
4,342,452 A 8/1982 Summa
4,344,616 A 8/1982 Ogden
4,349,597 A 9/1982 Fine et al.
4,350,336 A 9/1982 Hanford
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,369,081 A 1/1983 Curry et al.
4,370,766 A 2/1983 Teague, Jr.
4,374,587 A 2/1983 Ogden
4,377,045 A 3/1983 Aurensan
4,383,684 A 5/1983 Schliep
4,383,714 A 5/1983 Ishida
4,397,462 A 8/1983 Wilmarth
4,406,451 A 9/1983 Gaetano
4,408,613 A 10/1983 Relyea
4,422,635 A 12/1983 Herod
4,422,636 A 12/1983 de Angeli
4,423,864 A 1/1984 Wiik
4,426,077 A 1/1984 Becker
4,431,181 A 2/1984 Baswell
4,434,981 A 3/1984 Norton
4,441,708 A 4/1984 Brentham
4,445,684 A 5/1984 Ruff
4,452,448 A 6/1984 Ausherman
4,453,766 A 6/1984 DiVito
4,461,472 A 7/1984 Martinez
4,465,277 A 8/1984 Dittrich
4,476,582 A 10/1984 Strauss et al.
4,477,071 A 10/1984 Brown et al.
4,489,933 A 12/1984 Fisher
4,491,318 A 1/1985 Francke
4,494,662 A 1/1985 Clymer
4,496,147 A 1/1985 DeCloux et al.
4,499,784 A 2/1985 Shum
4,502,679 A 3/1985 De Lorenzo
4,505,474 A 3/1985 Mattox
4,505,475 A 3/1985 Olschansky et al.
4,509,510 A 4/1985 Hook
4,512,567 A 4/1985 Phillips
4,512,571 A 4/1985 Hermelin
4,522,394 A 6/1985 Broussard
4,529,194 A 7/1985 Haaheim
4,533,136 A 8/1985 Smith et al.
4,536,244 A 8/1985 Greci et al.
4,538,805 A 9/1985 Parviainen
4,542,899 A 9/1985 Hendricks
4,544,152 A 10/1985 Taitel
4,544,153 A 10/1985 Babcock
4,546,971 A 10/1985 Raasoch
4,548,405 A 10/1985 Lee
4,549,733 A 10/1985 Salyer
4,556,216 A 12/1985 Pitkanen
4,563,001 A 1/1986 Terauds
4,563,003 A 1/1986 Bugallo et al.
4,564,193 A 1/1986 Stewart
4,566,689 A 1/1986 Ogden
4,566,732 A 1/1986 Ostergaard, Sr.
4,569,518 A 2/1986 Fulks
4,571,682 A 2/1986 Silverman et al.
4,572,500 A 2/1986 Weiss
4,572,504 A 2/1986 DiBartolo
4,576,352 A 3/1986 Ogden
4,576,376 A 3/1986 Miller
4,577,860 A 3/1986 Matias et al.
4,580,983 A 4/1986 Cassini et al.
4,581,269 A 4/1986 Tilman
4,582,320 A 4/1986 Shaw
4,589,656 A 5/1986 Baldwin
4,591,147 A 5/1986 Smith et al.
4,592,544 A 6/1986 Smith et al.
4,600,196 A 7/1986 Jones
4,601,142 A 7/1986 Frommelt
4,602,779 A 7/1986 Ogden
4,610,449 A 9/1986 Diercks, Jr.
4,614,337 A 9/1986 Schonenberger
4,616,822 A 10/1986 Trulaske
4,618,139 A 10/1986 Haaheim

(56) References Cited

U.S. PATENT DOCUMENTS 4,618,140 A 10/1986 Brown
4,619,454 A 10/1986 Walton
4,621,623 A 11/1986 Wang
4,624,457 A 11/1986 Silberman et al.
4,625,962 A 12/1986 Street
4,627,614 A 12/1986 De Angeli
4,627,615 A 12/1986 Nurkowski
4,627,616 A 12/1986 Kauffman
4,630,817 A 12/1986 Buckley
4,632,385 A 12/1986 Geraci
4,632,386 A 12/1986 Beech
4,632,390 A 12/1986 Richey
4,634,127 A 1/1987 Rockwell
4,635,927 A 1/1987 Shu
4,635,928 A 1/1987 Ogden et al.
4,637,605 A 1/1987 Ritchie
4,638,523 A 1/1987 Todd
4,638,969 A 1/1987 Brown
4,641,833 A 2/1987 Trethewey
4,642,080 A 2/1987 Takano et al.
4,643,418 A 2/1987 Bart
4,645,197 A 2/1987 Mcfee
4,645,200 A 2/1987 Hix
4,645,201 A 2/1987 Evans
4,645,917 A 2/1987 Penney et al.
4,647,041 A 3/1987 Whiteley
4,650,067 A 3/1987 Brule
4,650,184 A 3/1987 Brebner
4,650,185 A 3/1987 Cartwright
4,651,581 A 3/1987 Svensson
4,659,074 A 4/1987 Taitel et al.
4,659,077 A 4/1987 Stropkay
4,659,078 A 4/1987 Blome
4,662,630 A 5/1987 Dignard et al.
4,664,371 A 5/1987 Viander
4,664,373 A 5/1987 Hait
4,664,646 A 5/1987 Rorabaugh
4,673,177 A 6/1987 Szymski
4,674,740 A 6/1987 Iams et al.
4,674,743 A 6/1987 Hirano
4,678,185 A 7/1987 Mahnke
4,679,787 A 7/1987 Guilbault
4,684,121 A 8/1987 Nestegard
4,685,670 A 8/1987 Zinkin
4,687,195 A 8/1987 Potts
4,697,809 A 10/1987 Rockwell
4,700,946 A 10/1987 Breunig
4,702,475 A 10/1987 Elstein et al.
4,705,267 A 11/1987 Jackson
4,708,337 A 11/1987 Shyu
4,709,917 A 12/1987 Yang
4,709,918 A 12/1987 Grinblat
4,709,920 A 12/1987 Schnell
4,711,447 A 12/1987 Mansfield
4,714,248 A 12/1987 Koss
4,718,207 A 1/1988 Frommelt
4,720,093 A 1/1988 Del Mar
4,720,099 A 1/1988 Carlson
4,720,789 A 1/1988 Hector et al.
4,721,303 A 1/1988 Fitzpatrick
4,725,057 A 2/1988 Shifferaw
4,726,581 A 2/1988 Chang
4,729,558 A 3/1988 Kuo
4,729,562 A 3/1988 Pipasik
4,733,858 A 3/1988 Lan
4,743,009 A 5/1988 Beale
4,743,015 A 5/1988 Marshall
4,744,559 A 5/1988 Mahnke et al.
4,746,115 A 5/1988 Lahman
4,749,184 A 6/1988 Tobin
4,750,736 A 6/1988 Watterson
4,751,755 A 6/1988 Carey, Jr. et al.
4,756,098 A 7/1988 Boggia
4,757,987 A 7/1988 Allemand
4,759,540 A 7/1988 Yu et al.
4,771,148 A 9/1988 Bersonnet
4,772,015 A 9/1988 Carlson et al.
4,773,170 A 9/1988 Moore et al.
4,776,582 A 10/1988 Ramhorst
4,779,884 A 10/1988 Minati
4,786,049 A 11/1988 Lautenschlager
4,786,050 A 11/1988 Geschwender
4,788,493 A 11/1988 Liptak
4,790,528 A 12/1988 Nakao et al.
4,792,134 A 12/1988 Chen
4,797,968 A 1/1989 Wenzlick
4,798,760 A 1/1989 Diaz-Kotti
4,799,475 A 1/1989 Iams et al.
4,799,671 A 1/1989 Hoggan et al.
4,801,079 A 1/1989 Gonella
4,804,178 A 2/1989 Friedebach
4,805,901 A 2/1989 Kulick
4,807,874 A 2/1989 Little
4,809,804 A 3/1989 Houston et al.
4,809,972 A 3/1989 Rasmussen et al.
4,813,667 A 3/1989 Watterson
4,813,668 A 3/1989 Solloway
4,813,743 A 3/1989 Mizelle
4,817,939 A 4/1989 Augspurger et al.
4,818,175 A 4/1989 Kimura
4,819,583 A 4/1989 Guerra
4,822,029 A 4/1989 Sarno
4,822,034 A 4/1989 Shields
4,824,104 A 4/1989 Bloch
4,826,153 A 5/1989 Schalip
4,826,157 A 5/1989 Fitzpatrick
4,826,158 A 5/1989 Fields, Jr.
4,826,159 A 5/1989 Hersey
4,828,255 A 5/1989 Lahman
4,828,257 A 5/1989 Dyer et al.
4,830,362 A 5/1989 Bull
4,832,332 A 5/1989 Dumbser
4,836,530 A 6/1989 Stanley, Jr.
4,838,543 A 6/1989 Armstrong et al.
4,838,544 A 6/1989 Sasakawa et al.
4,842,266 A 6/1989 Sweeney, Sr.
4,842,274 A 6/1989 Oosthuizen
4,844,449 A 7/1989 Truslaske
4,844,450 A 7/1989 Rodgers, Jr.
4,848,737 A 7/1989 Ehrenfield
4,850,585 A 7/1989 Dalebout
4,861,023 A 8/1989 Wedman
4,861,025 A 8/1989 Rockwell
4,863,161 A 9/1989 Telle
4,865,344 A 9/1989 Romero, Sr. et al.
4,867,443 A 9/1989 Jensen
4,869,493 A 9/1989 Johnston
4,869,494 A 9/1989 Lambert, Sr.
4,869,497 A 9/1989 Stewart et al.
4,875,676 A 10/1989 Zimmer
4,877,239 A 10/1989 Dela Rosa
4,878,662 A 11/1989 Chern
4,878,663 A 11/1989 Luquette
4,880,227 A 11/1989 Sowell
4,883,272 A 11/1989 Lay
4,886,266 A 12/1989 Trulaske
4,891,764 A 1/1990 McIntosh
4,894,933 A 1/1990 Tonkel et al.
4,898,379 A 2/1990 Shiba
4,898,381 A 2/1990 Gordon
4,900,012 A 2/1990 Fu
4,900,017 A 2/1990 Bold, Jr.
4,900,018 A 2/1990 Ish, III
4,902,006 A 2/1990 Stallings, Jr.
4,904,829 A 2/1990 Berthaud et al.
4,905,330 A 3/1990 Jacobs
4,907,795 A 3/1990 Shaw et al.
4,907,797 A 3/1990 Gezari et al.
4,907,798 A 3/1990 Burchatz
4,909,504 A 3/1990 Yang
4,911,438 A 3/1990 Van Straaten
4,913,396 A 4/1990 Dalebout et al.
4,913,423 A 4/1990 Farran
4,915,377 A 4/1990 Malnke et al.

(56) References Cited

U.S. PATENT DOCUMENTS 4,915,379 A 4/1990 Sapp
4,917,376 A 4/1990 Lo
4,919,418 A 4/1990 Miller
4,919,419 A 4/1990 Houston
4,921,242 A 5/1990 Watterson
4,921,247 A 5/1990 Sterling
4,923,193 A 5/1990 Pitzen et al.
4,925,183 A 5/1990 Kim
4,925,724 A 5/1990 Ogden
4,927,136 A 5/1990 Leask
4,928,546 A 5/1990 Walters
4,928,957 A 5/1990 Lanier et al.
4,930,768 A 6/1990 Lapcevic
4,930,769 A 6/1990 Nenoff
4,934,690 A 6/1990 Bull
4,934,692 A 6/1990 Owens
4,938,473 A 7/1990 Lee
4,940,233 A 7/1990 Bull
4,941,652 A 7/1990 Nagano et al.
4,941,673 A 7/1990 Bennett
4,948,121 A 8/1990 Haaheim et al.
4,949,954 A 8/1990 Hix
4,949,958 A 8/1990 Richey
4,949,959 A 8/1990 Stevens
4,952,265 A 8/1990 Yamanaka et al.
4,953,415 A 9/1990 Lehtonen
4,953,858 A 9/1990 Zelli
4,955,466 A 9/1990 Almes et al.
4,958,832 A 9/1990 Kim
4,960,276 A 10/1990 Feuer et al.
4,964,632 A 10/1990 Rockwell
4,968,028 A 11/1990 Wehrell
4,971,316 A 11/1990 Dalebout et al.
4,974,831 A 12/1990 Dunham
4,974,832 A 12/1990 Dalebout
4,976,424 A 12/1990 Sargeant et al.
4,976,428 A 12/1990 Ghazi
4,976,435 A 12/1990 Shatford
4,984,810 A 1/1991 Stearns et al.
4,986,261 A 1/1991 Iams et al.
4,989,860 A 2/1991 Iams et al.
4,998,725 A 3/1991 Watterson et al.
5,000,440 A 3/1991 Lynch
5,000,442 A 3/1991 Dalebout et al.
5,001,632 A 3/1991 Hall Tipping
5,002,271 A 3/1991 Gonzales
5,004,224 A 4/1991 Wang
5,007,630 A 4/1991 Real et al.
5,007,631 A 4/1991 Wang
5,013,031 A 5/1991 Bull
5,016,870 A 5/1991 Bulloch et al.
5,020,793 A 6/1991 Loane
5,024,441 A 6/1991 Rousseau
5,026,049 A 6/1991 Goodman
5,027,303 A 6/1991 Witte
5,029,801 A 7/1991 Dalebout et al.
5,031,455 A 7/1991 Cline
5,031,901 A 7/1991 Saarinen
5,034,576 A 7/1991 Dalebout et al.
RE33,662 E 8/1991 Blair et al.
5,037,084 A 8/1991 Flor
5,037,089 A 8/1991 Spagnuolo
5,039,089 A 8/1991 Lapcevic
5,039,091 A 8/1991 Johnson
5,042,799 A 8/1991 Stanley
5,046,382 A 9/1991 Steinberg
5,046,722 A 9/1991 Antoon
5,048,823 A 9/1991 Bean
5,051,638 A 9/1991 Pyles
5,054,770 A 10/1991 Bull
5,058,881 A 10/1991 Measom
5,058,882 A 10/1991 Dalebout et al.
5,058,888 A 10/1991 Walker et al.
5,062,626 A 11/1991 Dalebout et al.
5,062,629 A 11/1991 Vaughan
5,062,632 A 11/1991 Dalebout et al.
5,066,000 A 11/1991 Dolan
5,067,710 A 11/1991 Watterson et al.
5,071,115 A 12/1991 Welch
5,072,928 A 12/1991 Stearns et al.
5,072,929 A 12/1991 Peterson et al.
5,074,550 A 12/1991 Sloan
5,077,916 A 1/1992 Beneteau
5,080,353 A 1/1992 Tench
5,081,991 A 1/1992 Chance
5,085,426 A 2/1992 Wanzer et al.
5,085,427 A 2/1992 Finn
5,087,047 A 2/1992 McConnell
5,088,729 A 2/1992 Dalebout
5,094,249 A 3/1992 Marras et al.
5,094,447 A 3/1992 Wang
5,096,225 A 3/1992 Osawa
5,102,122 A 4/1992 Piane, Jr.
5,102,380 A 4/1992 Jacobson et al.
5,104,119 A 4/1992 Lynch
5,104,120 A 4/1992 Watterson et al.
5,108,093 A 4/1992 Watterson
5,109,778 A 5/1992 Berkowitz et al.
5,110,117 A 5/1992 Fisher et al.
5,112,045 A 5/1992 Mason et al.
5,114,388 A 5/1992 Trulaske
5,114,391 A 5/1992 Pitzen et al.
5,123,629 A 6/1992 Takeuchi
5,123,885 A 6/1992 Shields
5,123,886 A 6/1992 Cook
5,129,872 A 7/1992 Dalton et al.
5,131,895 A 7/1992 Rogers, Jr.
5,135,458 A 8/1992 Huang
5,137,501 A 8/1992 Mertesdorf
5,138,730 A 8/1992 Masuda
5,141,480 A 8/1992 Lennox et al.
5,142,358 A 8/1992 Jason
5,145,475 A 9/1992 Cares
5,145,481 A 9/1992 Friedebach
5,147,266 A 9/1992 Ricard
5,149,084 A 9/1992 Dalebout et al.
5,149,312 A 9/1992 Croft et al.
5,154,684 A 10/1992 Delf
5,158,520 A 10/1992 Lemke et al.
5,162,029 A 11/1992 Schine
5,163,885 A 11/1992 Wanzer et al.
5,167,159 A 12/1992 Lucking
5,167,597 A 12/1992 David
5,171,196 A 12/1992 Lynch
5,178,593 A 1/1993 Roberts
5,178,599 A 1/1993 Scott
5,181,894 A 1/1993 Shieng
5,184,295 A 2/1993 Mann
5,184,988 A 2/1993 Dunham
5,186,697 A 2/1993 Rennex
5,192,255 A 3/1993 Dalebout et al.
5,192,257 A 3/1993 Panasewicz
5,192,258 A 3/1993 Keller
5,195,781 A 3/1993 Osawa
5,195,935 A 3/1993 Fencel
5,195,937 A 3/1993 Engel et al.
5,199,931 A 4/1993 Easley et al.
5,201,694 A 4/1993 Zappel
5,203,229 A 4/1993 Chen
5,203,800 A 4/1993 Meredith
5,203,826 A 4/1993 Dalebout
5,205,798 A 4/1993 Lekhtman
5,205,800 A 4/1993 Grant
5,207,489 A 5/1993 Miller
5,207,622 A 5/1993 Wilkinson et al.
5,207,625 A 5/1993 White
5,207,628 A 5/1993 Graham
5,211,617 A 5/1993 Millen
5,215,510 A 6/1993 Baran
5,217,422 A 6/1993 Domzalski
5,226,866 A 7/1993 Engel et al.
5,232,422 A 8/1993 Bishop, Jr.
5,234,392 A 8/1993 Clark
5,240,417 A 8/1993 Smithson et al.

(56) References Cited

U.S. PATENT DOCUMENTS 5,242,339 A 9/1993 Thornton
5,242,340 A 9/1993 Jerome
5,242,343 A 9/1993 Miller
5,242,347 A 9/1993 Keeton
5,247,853 A 9/1993 Dalebout
5,250,012 A 10/1993 Whitcomb, Jr.
5,250,013 A 10/1993 Brangi
5,254,067 A 10/1993 Habing et al.
5,256,117 A 10/1993 Potts et al.
5,256,118 A 10/1993 Chen
5,256,126 A 10/1993 Grotstein
5,257,701 A 11/1993 Edelson
5,257,964 A 11/1993 Petters
5,261,864 A 11/1993 Fitzpatrick
5,269,736 A 12/1993 Roberts
5,271,416 A 12/1993 Lepley
5,273,285 A 12/1993 Long
5,277,678 A 1/1994 Friedebach et al.
5,279,528 A 1/1994 Dalebout et al.
5,279,529 A 1/1994 Eschenbach
5,279,531 A 1/1994 Jen Huey
5,282,776 A 2/1994 Dalebout
5,284,461 A 2/1994 Wilkinson et al.
5,290,205 A 3/1994 Densmore et al.
5,290,211 A 3/1994 Stearns
5,292,293 A 3/1994 Schumacher
5,295,927 A 3/1994 Easley
5,295,928 A 3/1994 Rennex
5,295,935 A 3/1994 Wang
5,299,992 A 4/1994 Wilkinson
5,299,993 A 4/1994 Habing
5,302,162 A 4/1994 Pasero
5,306,221 A 4/1994 Itaru
5,308,075 A 5/1994 Theriault
5,308,304 A 5/1994 Habing
5,310,392 A 5/1994 Lo
5,313,852 A 5/1994 Arena
5,314,390 A 5/1994 Westing et al.
5,314,391 A 5/1994 Potash et al.
5,314,392 A 5/1994 Hawkins et al.
5,314,394 A 5/1994 Ronan
5,318,487 A 6/1994 Golen et al.
5,320,343 A 6/1994 McKinney
5,320,588 A 6/1994 Wanzer et al.
5,320,591 A 6/1994 Harmon et al.
5,320,641 A 6/1994 Riddle
5,324,242 A 6/1994 Lo
5,328,420 A 7/1994 Allen
5,328,422 A 7/1994 Nichols
5,328,429 A 7/1994 Potash et al.
5,330,401 A 7/1994 Walstead
5,330,402 A 7/1994 Johnson
5,334,120 A 8/1994 Rasmussen
5,336,144 A 8/1994 Rodden
5,336,145 A 8/1994 Keiser
5,336,146 A 8/1994 Piaget et al.
5,342,264 A 8/1994 Gordon
5,342,271 A 8/1994 Long
RE34,728 E 9/1994 Hall-Tipping
5,344,372 A 9/1994 Hung
5,348,524 A 9/1994 Grant
5,350,344 A 9/1994 Kissel
5,352,166 A 10/1994 Chang
5,352,167 A 10/1994 Ulicny
5,352,169 A 10/1994 Eschenbach
5,353,452 A 10/1994 Rulis
5,354,248 A 10/1994 Rawls et al.
5,354,251 A 10/1994 Sleamaker
5,356,356 A 10/1994 Hildebrandt et al.
5,358,461 A 10/1994 Bailey, Jr.
5,362,069 A 11/1994 Hall-Tipping
5,362,295 A 11/1994 Nurge
5,364,327 A 11/1994 Graham
5,368,532 A 11/1994 Farnet
5,372,556 A 12/1994 Ropp
5,372,559 A 12/1994 Dalebout et al.
5,372,560 A 12/1994 Chang
5,372,564 A 12/1994 Spirito
5,374,227 A 12/1994 Webb
5,378,212 A 1/1995 Pin-Kuo
5,380,258 A 1/1995 Hawley, Jr.
5,382,207 A 1/1995 Skowronski et al.
5,382,208 A 1/1995 Hu
5,382,209 A 1/1995 Pasier
5,383,827 A 1/1995 Stern
5,383,828 A 1/1995 Sands et al.
5,385,346 A 1/1995 Carroll et al.
5,385,519 A 1/1995 Hsu
5,387,169 A 2/1995 Wang
5,387,170 A 2/1995 Rawls et al.
5,387,171 A 2/1995 Casey et al.
5,394,922 A 3/1995 Colson et al.
5,396,876 A 3/1995 Liscio et al.
5,398,948 A 3/1995 Mathis
5,401,226 A 3/1995 Stearns
5,403,251 A 4/1995 Belsito et al.
5,403,252 A 4/1995 Leon et al.
5,403,253 A 4/1995 Gaylord
5,403,254 A 4/1995 Lundin et al.
5,403,255 A 4/1995 Johnston
5,406,661 A 4/1995 Pekar
5,407,403 A 4/1995 Coleman
5,407,408 A 4/1995 Wilkinson
5,409,435 A 4/1995 Daniels
RE34,959 E 5/1995 Potts
5,410,971 A 5/1995 Golden et al.
5,417,643 A 5/1995 Taylor
5,419,570 A 5/1995 Bollotte
5,419,571 A 5/1995 Vaughan
5,419,751 A 5/1995 Byrd et al.
5,423,729 A 6/1995 Eschenbach
5,423,730 A 6/1995 Hirsch
5,429,563 A 7/1995 Engel et al.
5,429,569 A 7/1995 Gunnari
5,431,612 A 7/1995 Holden
5,433,679 A 7/1995 Szymczak et al.
5,435,315 A 7/1995 McPhee et al.
5,435,798 A 7/1995 Habing et al.
5,441,467 A 8/1995 Stevens
5,441,468 A 8/1995 Deckers et al.
5,449,334 A 9/1995 Kingsbury
5,454,772 A 10/1995 Rodden
5,454,773 A 10/1995 Blanchard et al.
5,456,648 A 10/1995 Edinburg
5,460,379 A 10/1995 Cleland
5,460,586 A 10/1995 Wilkinson
5,462,503 A 10/1995 Benjamin et al.
5,462,504 A 10/1995 Trulaske et al.
5,466,200 A 11/1995 Ulrich et al.
5,466,203 A 11/1995 Chen
5,470,298 A 11/1995 Curtis
5,471,405 A 11/1995 Marsh
5,474,087 A 12/1995 Nashner
5,474,510 A 12/1995 Chen
5,476,430 A 12/1995 Lee et al.
5,484,358 A 1/1996 Wang et al.
5,484,362 A 1/1996 Skowronski et al.
5,487,707 A 1/1996 Sharf et al.
5,489,249 A 2/1996 Brewer et al.
5,489,250 A 2/1996 Densmore et al.
5,490,818 A 2/1996 Haber et al.
5,492,514 A 2/1996 Daum
5,492,520 A 2/1996 Brown
5,496,235 A 3/1996 Stevens
5,496,236 A 3/1996 Buonauito
5,496,238 A 3/1996 Taylor
5,496,239 A 3/1996 Kallman
5,499,956 A 3/1996 Habing et al.
5,505,011 A 4/1996 Bleimhofer
5,507,271 A 4/1996 Actor
5,509,870 A 4/1996 Lloyd
5,512,025 A 4/1996 Dalebout et al.
5,512,029 A 4/1996 Barnard
5,514,053 A 5/1996 Hawkins et al.

(56) References Cited

U.S. PATENT DOCUMENTS 5,518,471 A 5/1996 Hettinger et al.
5,518,473 A 5/1996 Miller
5,520,599 A 5/1996 Chen
5,522,783 A 6/1996 Gordon
5,527,245 A 6/1996 Dalebout et al.
5,529,554 A 6/1996 Eschenbach
5,531,658 A 7/1996 L. S. C.
5,533,899 A 7/1996 Young
5,533,948 A 7/1996 Wilkinson
5,533,951 A 7/1996 Chang
5,538,489 A 7/1996 Magid
5,542,892 A 8/1996 Buhler
5,545,112 A 8/1996 Densmore et al.
5,549,052 A 8/1996 Hoffman
5,549,536 A 8/1996 Clark
5,551,934 A 9/1996 Binette
5,551,937 A 9/1996 Kwo
5,554,033 A 9/1996 Bizzi et al.
5,554,083 A 9/1996 Chen
5,556,362 A 9/1996 Whipps
5,562,572 A 10/1996 Carmein
5,562,574 A 10/1996 Miller
5,563,487 A 10/1996 Davis
5,568,993 A 10/1996 Potzick
5,569,128 A 10/1996 Dalebout
5,569,138 A 10/1996 Wang et al.
5,573,485 A 11/1996 Geschwender
5,575,740 A 11/1996 Piaget
5,577,985 A 11/1996 Miller
5,577,987 A 11/1996 Brown
5,580,249 A 12/1996 Jacobsen et al.
5,582,563 A 12/1996 Fan
5,584,700 A 12/1996 Feldman et al.
5,584,779 A 12/1996 Knecht
5,585,561 A 12/1996 Bahl et al.
5,586,736 A 12/1996 Mollet
5,588,938 A 12/1996 Schneider et al.
5,590,893 A 1/1997 Robinson et al.
5,591,104 A 1/1997 Andrus et al.
5,591,106 A 1/1997 Dalebout et al.
5,591,107 A 1/1997 Rodgers, Jr.
5,591,908 A 1/1997 Reid
5,593,372 A 1/1997 Rodgers, Jr.
5,593,380 A 1/1997 Bittikofer
5,595,556 A 1/1997 Dalebout et al.
5,599,261 A 2/1997 Easley et al.
5,600,310 A 2/1997 Whipple, III et al.
5,603,675 A 2/1997 Wu
5,603,678 A 2/1997 Wilson
5,607,375 A 3/1997 Dalebout
5,613,216 A 3/1997 Galler
5,613,856 A 3/1997 Hoover
5,616,103 A 4/1997 Lee
5,622,527 A 4/1997 Watterson et al.
5,625,577 A 4/1997 Kunii et al.
5,626,539 A 5/1997 Piaget
5,630,566 A 5/1997 Case
5,632,209 A 5/1997 Sakakibara
5,634,870 A 6/1997 Wilkinson
5,643,142 A 7/1997 Salerno et al.
5,643,144 A 7/1997 Trulaske
5,643,147 A 7/1997 Huang
5,643,152 A 7/1997 Simonson
5,643,153 A 7/1997 Nylen et al.
5,643,157 A 7/1997 Seliber
5,645,509 A 7/1997 Brewer et al.
5,645,914 A 7/1997 Horowitz
5,649,882 A 7/1997 Parikh et al.
5,650,709 A 7/1997 Rotunda et al.
5,653,662 A 8/1997 Rodgers, Jr.
5,655,997 A 8/1997 Greenberg et al.
5,656,003 A 8/1997 Robinson et al.
5,658,227 A 8/1997 Stearns
5,662,557 A 9/1997 Watterson et al.
5,665,031 A 9/1997 Palmer
5,665,033 A 9/1997 Palmer
5,667,459 A 9/1997 Su
5,669,833 A 9/1997 Stone
5,669,857 A 9/1997 Watterson et al.
5,669,865 A 9/1997 Gordon
5,672,140 A 9/1997 Watterson et al.
5,674,156 A 10/1997 Watterson et al.
5,674,453 A 10/1997 Watterson et al.
5,676,624 A 10/1997 Watterson et al.
5,679,047 A 10/1997 Engel
5,679,101 A 10/1997 Magid
5,683,332 A 11/1997 Watterson et al.
5,685,804 A 11/1997 Whan-Tong et al.
5,688,209 A 11/1997 Trulaske et al.
5,688,216 A 11/1997 Mauriello
5,690,582 A 11/1997 Ulrich et al.
5,690,587 A 11/1997 Gruenangerl
5,690,589 A 11/1997 Rodgers, Jr.
5,692,994 A 12/1997 Eschenbach
5,695,436 A 12/1997 Huang
5,702,325 A 12/1997 Watterson et al.
5,704,879 A 1/1998 Watterson et al.
5,707,319 A 1/1998 Riley
5,708,355 A 1/1998 Schrey
5,709,632 A 1/1998 Socwell
5,709,633 A 1/1998 Sokol
5,711,745 A 1/1998 Yang
5,711,749 A 1/1998 Miller
5,713,549 A 2/1998 Shieh
5,713,821 A 2/1998 Nissen
5,716,308 A 2/1998 Lee
5,718,657 A 2/1998 Dalebout et al.
5,718,660 A 2/1998 Chen
5,720,200 A 2/1998 Anderson et al.
5,720,474 A 2/1998 Sugiyama
5,722,917 A 3/1998 Olschansky et al.
5,722,920 A 3/1998 Bauer
5,722,922 A 3/1998 Watterson et al.
5,725,459 A 3/1998 Rexach
5,730,236 A 3/1998 Miller et al.
5,733,228 A 3/1998 Stevens
5,733,229 A 3/1998 Dalebout et al.
5,735,586 A 4/1998 Cheng
5,735,773 A 4/1998 Vittone
5,735,776 A 4/1998 Swezey
5,738,612 A 4/1998 Tsuda
5,741,205 A 4/1998 Doll et al.
5,743,193 A 4/1998 Kakuta et al.
5,743,832 A 4/1998 Sands et al.
5,743,833 A 4/1998 Watterson et al.
5,743,835 A 4/1998 Trotter
5,746,682 A 5/1998 Hung
5,749,372 A 5/1998 Allen
5,749,787 A 5/1998 Jank
5,749,807 A 5/1998 Webb
5,749,809 A 5/1998 Lin
5,749,813 A 5/1998 Domzalski
5,752,879 A 5/1998 Berdut
5,752,897 A 5/1998 Skowronski et al.
5,755,642 A 5/1998 Miller
5,755,645 A 5/1998 Miller et al.
5,755,651 A 5/1998 Homyonfer
5,759,136 A 6/1998 Chen
5,760,353 A 6/1998 Rapp
5,761,831 A 6/1998 Cho
5,762,587 A 6/1998 Dalebout et al.
5,762,588 A 6/1998 Chen
5,769,759 A 6/1998 Alter
5,771,152 A 6/1998 Crompton et al.
5,772,522 A 6/1998 Nesbit
5,772,558 A 6/1998 Rodgers, Jr.
5,772,560 A 6/1998 Watterson et al.
5,776,582 A 7/1998 Needham
5,779,599 A 7/1998 Chen
5,779,607 A 7/1998 Harris
5,782,639 A 7/1998 Beal
5,782,723 A 7/1998 Kuo
5,785,630 A 7/1998 Bobick et al.
5,788,609 A 8/1998 Miller

(56) References Cited

U.S. PATENT DOCUMENTS 5,788,610 A 8/1998 Eschenbach
5,788,611 A 8/1998 Kuo
5,792,027 A 8/1998 Gvoich
5,792,031 A 8/1998 Alton
5,795,270 A 8/1998 Woods et al.
5,797,578 A 8/1998 Graffeo
5,803,874 A 9/1998 Wilkinson
5,803,882 A 9/1998 Habing et al.
5,807,210 A 9/1998 Devlin
5,810,696 A 9/1998 Webb
5,810,697 A 9/1998 Joiner
5,810,698 A 9/1998 Hullett et al.
5,813,142 A 9/1998 Demon
5,813,947 A 9/1998 Densmore
5,813,953 A 9/1998 Whipple
5,816,981 A 10/1998 Hung
5,820,478 A 10/1998 Wood et al.
5,823,618 A 10/1998 Fox et al.
5,827,155 A 10/1998 Jensen et al.
5,827,158 A 10/1998 Drecksel
5,830,107 A 11/1998 Brigliadoro
5,830,113 A 11/1998 Coody et al.
5,830,114 A 11/1998 Halfen et al.
5,833,577 A 11/1998 Hurt
5,833,583 A 11/1998 Chuang
5,833,584 A 11/1998 Piaget et al.
5,833,587 A 11/1998 Strong et al.
5,836,770 A 11/1998 Powers
5,839,990 A 11/1998 Virkkala
5,839,993 A 11/1998 Fox
5,842,961 A 12/1998 Davis
5,846,166 A 12/1998 Kuo
5,848,954 A 12/1998 Stearns et al.
5,852,264 A 12/1998 Muller
5,855,537 A 1/1999 Coody et al.
5,855,538 A 1/1999 Argabright
5,857,939 A 1/1999 Kaufman
5,857,940 A 1/1999 Husted
5,857,941 A 1/1999 Maresh
5,857,943 A 1/1999 Murray
5,860,893 A 1/1999 Watterson et al.
5,860,894 A 1/1999 Dalebout et al.
5,860,899 A 1/1999 Rassman
5,865,710 A 2/1999 Wilson-Hyde
5,868,108 A 2/1999 Schmitz et al.
5,868,648 A 2/1999 Coody et al.
5,871,421 A 2/1999 Trulaske et al.
5,876,095 A 3/1999 Johnston
5,879,273 A 3/1999 Wei
5,879,276 A 3/1999 Miller
5,882,281 A 3/1999 Stearns et al.
5,885,197 A 3/1999 Barton
5,888,172 A 3/1999 Andrus et al.
5,890,562 A 4/1999 Bartels et al.
5,890,995 A 4/1999 Bobick et al.
5,891,001 A 4/1999 Carnes et al.
5,891,003 A 4/1999 Deac et al.
5,895,339 A 4/1999 Maresh
5,895,340 A 4/1999 Keller
5,897,457 A 4/1999 Mackovjak
5,897,459 A 4/1999 Habing et al.
5,897,460 A 4/1999 McBride et al.
5,897,461 A 4/1999 Socwell
5,899,833 A 5/1999 Ryan et al.
5,899,834 A 5/1999 Dalebout et al.
5,902,214 A 5/1999 Makikawa et al.
5,904,398 A 5/1999 Farricielli
5,904,636 A 5/1999 Chen
5,906,269 A 5/1999 Zabron et al.
5,906,564 A 5/1999 Jacobsen
5,910,070 A 6/1999 Henry et al.
5,910,072 A 6/1999 Rawls et al.
5,911,132 A 6/1999 Sloane
5,913,751 A 6/1999 Eschenbach
5,916,064 A 6/1999 Eschenbach
5,916,069 A 6/1999 Wang
5,917,692 A 6/1999 Schmitz et al.
5,919,118 A 7/1999 Stearns
5,921,892 A 7/1999 Easton
5,921,896 A 7/1999 Boland
5,925,001 A 7/1999 Hoyt et al.
5,938,551 A 8/1999 Warner
5,938,565 A 8/1999 Bernacki
5,938,570 A 8/1999 Maresh
5,938,571 A 8/1999 Stevens
5,938,575 A 8/1999 Stearns
5,940,502 A 8/1999 Hirai et al.
5,940,911 A 8/1999 Wang
5,941,807 A 8/1999 Cassidy
5,943,794 A 8/1999 Gelsomini
5,944,641 A 8/1999 Habing
5,947,869 A 9/1999 Shea
5,947,872 A 9/1999 Ryan et al.
5,951,444 A 9/1999 Webber
5,951,447 A 9/1999 Butler
5,951,449 A 9/1999 Oppriecht
5,957,814 A 9/1999 Eschenbach
5,961,423 A 10/1999 Sellers
5,961,430 A 10/1999 Zuckerman et al.
5,967,944 A 10/1999 Vittone et al.
5,967,954 A 10/1999 Habing
5,967,955 A 10/1999 Westfall et al.
5,971,902 A 10/1999 Robertson et al.
5,976,061 A 11/1999 Moon et al.
5,980,430 A 11/1999 Wang
5,980,432 A 11/1999 Ahman
5,984,798 A 11/1999 Gilmour
5,984,839 A 11/1999 Corkum
5,989,161 A 11/1999 Wang et al.
5,989,163 A 11/1999 Rodgers, Jr.
5,989,168 A 11/1999 See
5,991,143 A 11/1999 Wright et al.
5,993,358 A 11/1999 Gureghian et al.
5,993,359 A 11/1999 Eschenbach
5,993,362 A 11/1999 Ghobadi
5,997,447 A 12/1999 Giannelli et al.
5,997,450 A 12/1999 Wilkinson
6,003,481 A 12/1999 Pischinger et al.
6,004,244 A 12/1999 Simonson
6,006,379 A 12/1999 Hensley
6,010,432 A 1/2000 Vawter
6,012,591 A 1/2000 Brandenberg
6,012,772 A 1/2000 Conde et al.
6,013,011 A 1/2000 Moore et al.
6,015,367 A 1/2000 Scaramucci
6,015,368 A 1/2000 Clem
6,027,429 A 2/2000 Daniels
6,027,430 A 2/2000 Stearns et al.
6,027,432 A 2/2000 Cheng
6,029,858 A 2/2000 Srokose et al.
6,030,320 A 2/2000 Stearns
6,030,321 A 2/2000 Fuentes
6,030,323 A 2/2000 Fontenot
6,033,344 A 3/2000 Trulaske et al.
6,033,347 A 3/2000 Dalebout et al.
6,033,350 A 3/2000 Krull
6,036,622 A 3/2000 Gordon
6,042,512 A 3/2000 Eschenbach
6,042,514 A 3/2000 Abelbeck
6,042,515 A 3/2000 Wang
6,042,516 A 3/2000 Norton
6,042,518 A 3/2000 Hildebrandt et al.
6,042,523 A 3/2000 Graham
6,045,487 A 4/2000 Miller
6,045,488 A 4/2000 Eschenbach
6,045,490 A 4/2000 Shafer
6,045,491 A 4/2000 McNergney
6,050,920 A 4/2000 Ehrenfried
6,050,921 A 4/2000 Wang
6,050,922 A 4/2000 Wang
6,050,923 A 4/2000 Yu
6,053,844 A 4/2000 Clem
6,053,847 A 4/2000 Stearns et al.
6,053,848 A 4/2000 Eschenbach

(56) References Cited

U.S. PATENT DOCUMENTS

| | | | |
|---|---|---|---|
| 6,055,747 | A | 5/2000 | Lombardino |
| 6,056,678 | A | 5/2000 | Giannelli et al. |
| 6,059,692 | A | 5/2000 | Hickman |
| 6,059,695 | A | 5/2000 | Hung |
| 6,063,009 | A | 5/2000 | Stearns |
| 6,066,075 | A | 5/2000 | Poulton |
| 6,068,578 | A | 5/2000 | Wang |
| 6,068,579 | A | 5/2000 | Killian et al. |
| 6,071,031 | A | 6/2000 | Bailey |
| 6,071,216 | A | 6/2000 | Giannelli et al. |
| 6,075,525 | A | 6/2000 | Hsieh |
| 6,077,196 | A | 6/2000 | Eschenbach |
| 6,077,198 | A | 6/2000 | Eschenbach |
| 6,077,199 | A | 6/2000 | Hsu |
| 6,077,200 | A | 6/2000 | Lin |
| 6,080,091 | A | 6/2000 | Habing et al. |
| 6,086,520 | A | 7/2000 | Rodriquez |
| 6,090,014 | A | 7/2000 | Eschenbach |
| 6,090,016 | A | 7/2000 | Kuo |
| 6,095,951 | A | 8/2000 | Skowronski et al. |
| 6,099,439 | A | 8/2000 | Ryan et al. |
| 6,102,412 | A | 8/2000 | Staffaroni |
| 6,102,832 | A | 8/2000 | Tani |
| 6,110,076 | A | 8/2000 | Hurt |
| 6,110,077 | A | 8/2000 | Yu |
| 6,113,188 | A | 9/2000 | Stewart et al. |
| 6,113,522 | A | 9/2000 | Montgomery |
| 6,117,049 | A | 9/2000 | Lowe |
| 6,120,421 | A | 9/2000 | Kuo |
| 6,123,646 | A | 9/2000 | Colassi |
| 6,123,648 | A | 9/2000 | Stevens |
| 6,123,649 | A | 9/2000 | Lee |
| 6,123,650 | A | 9/2000 | Birrell |
| 6,125,851 | A | 10/2000 | Walker et al. |
| 6,126,574 | A | 10/2000 | Stearns et al. |
| 6,126,575 | A | 10/2000 | Wang |
| 6,126,576 | A | 10/2000 | Wang |
| 6,129,962 | A | 10/2000 | Quigley et al. |
| 6,132,314 | A | 10/2000 | Aiki |
| 6,132,340 | A | 10/2000 | Wang |
| 6,135,924 | A | 10/2000 | Gibbs et al. |
| 6,135,925 | A | 10/2000 | Liu |
| 6,142,870 | A | 11/2000 | Wada et al. |
| 6,142,913 | A | 11/2000 | Ewert |
| 6,142,914 | A | 11/2000 | Crawford et al. |
| 6,142,915 | A | 11/2000 | Eschenbach |
| 6,146,315 | A | 11/2000 | Schonenberger |
| 6,149,551 | A | 11/2000 | Pyles et al. |
| 6,149,552 | A | 11/2000 | Chen |
| 6,152,856 | A | 11/2000 | Studor et al. |
| 6,152,859 | A | 11/2000 | Stearns |
| 6,162,183 | A | 12/2000 | Hoover |
| 6,163,451 | A | 12/2000 | Chiu |
| 6,165,107 | A | 12/2000 | Birrell |
| 6,168,551 | B1 | 1/2001 | Mcguinness |
| 6,171,216 | B1 | 1/2001 | Wang |
| 6,174,267 | B1 | 1/2001 | Dalebout |
| 6,174,268 | B1 | 1/2001 | Novak |
| 6,176,814 | B1 | 1/2001 | Ryan et al. |
| 6,179,753 | B1 | 1/2001 | Barker et al. |
| 6,181,647 | B1 | 1/2001 | Tipton et al. |
| 6,183,397 | B1 | 2/2001 | Stearns et al. |
| 6,186,290 | B1 | 2/2001 | Carlson |
| 6,186,460 | B1 | 2/2001 | Lin |
| 6,186,929 | B1 | 2/2001 | Endelman et al. |
| 6,189,846 | B1 | 2/2001 | Wang |
| 6,190,289 | B1 | 2/2001 | Pyles et al. |
| 6,193,635 | B1 | 2/2001 | Webber et al. |
| 6,203,474 | B1 | 3/2001 | Jones |
| 6,206,795 | B1 | 3/2001 | Ou |
| 6,210,305 | B1 | 4/2001 | Eschenbach |
| 6,213,919 | B1 | 4/2001 | Wang |
| 6,215,870 | B1 | 4/2001 | Hirai et al. |
| 6,217,487 | B1 | 4/2001 | Reinert |
| 6,220,990 | B1 | 4/2001 | Crivello |
| 6,220,995 | B1 | 4/2001 | Chen |
| 6,224,516 | B1 | 5/2001 | Disch |
| 6,224,519 | B1 | 5/2001 | Doolittle |
| 6,230,047 | B1 | 5/2001 | McHugh |
| 6,230,460 | B1 | 5/2001 | Huyett |
| 6,231,482 | B1 | 5/2001 | Thompson |
| 6,231,946 | B1 | 5/2001 | Brown, Jr. et al. |
| 6,234,935 | B1 | 5/2001 | Chu |
| 6,234,936 | B1 | 5/2001 | Wang |
| 6,237,583 | B1 | 5/2001 | Ripley et al. |
| 6,238,323 | B1 | 5/2001 | Simonson |
| 6,241,638 | B1 | 6/2001 | Hurt |
| 6,244,988 | B1 | 6/2001 | Delman |
| 6,244,992 | B1 | 6/2001 | James |
| 6,245,001 | B1 | 6/2001 | Siaperas |
| 6,251,047 | B1 | 6/2001 | Stearns et al. |
| 6,251,048 | B1 | 6/2001 | Kaufman |
| 6,254,514 | B1 | 7/2001 | Maresh et al. |
| 6,254,515 | B1 | 7/2001 | Carman et al. |
| 6,261,209 | B1 | 7/2001 | Coody |
| 6,264,586 | B1 | 7/2001 | Webber |
| 6,267,710 | B1 | 7/2001 | Liu |
| 6,273,842 | B1 | 8/2001 | Wang |
| 6,273,843 | B1 | 8/2001 | Lo |
| 6,276,749 | B1 | 8/2001 | Okazawa et al. |
| 6,277,054 | B1 | 8/2001 | Kuo |
| 6,277,056 | B1 | 8/2001 | McBride et al. |
| 6,280,361 | B1 | 8/2001 | Harvey et al. |
| 6,280,362 | B1 | 8/2001 | Dalebout et al. |
| 6,280,367 | B1 | 8/2001 | Arsenault |
| 6,282,816 | B1 | 9/2001 | Rosendahl |
| 6,283,896 | B1 | 9/2001 | Grunfeld |
| 6,287,240 | B1 | 9/2001 | Trabbic |
| 6,293,375 | B1 | 9/2001 | Chen |
| 6,299,959 | B1 | 10/2001 | Squires et al. |
| 6,302,815 | B1 | 10/2001 | Shishido et al. |
| 6,302,826 | B1 | 10/2001 | Lee |
| 6,302,828 | B1 | 10/2001 | Martin et al. |
| 6,302,829 | B1 | 10/2001 | Schmidt |
| 6,302,830 | B1 | 10/2001 | Stearns |
| 6,302,833 | B1 | 10/2001 | Ellis et al. |
| 6,306,108 | B1 | 10/2001 | Butler |
| 6,307,167 | B1 | 10/2001 | Kajio et al. |
| 6,312,363 | B1 | 11/2001 | Watterson et al. |
| 6,314,667 | B1 | 11/2001 | Rife et al. |
| 6,315,486 | B1 | 11/2001 | Lunz |
| 6,322,059 | B1 | 11/2001 | Kelm et al. |
| 6,322,481 | B1 | 11/2001 | Krull |
| 6,325,745 | B1 | 12/2001 | Yu |
| 6,325,746 | B1 | 12/2001 | Wang |
| 6,328,676 | B1 | 12/2001 | Alessandri |
| 6,328,677 | B1 | 12/2001 | Drapeau |
| 6,334,624 | B1 | 1/2002 | Giglio |
| 6,344,986 | B1 | 2/2002 | Jain et al. |
| 6,347,603 | B1 | 2/2002 | Felger |
| 6,348,028 | B1 | 2/2002 | Cragg |
| 6,350,218 | B1 | 2/2002 | Dalebout et al. |
| 6,352,494 | B2 | 3/2002 | McAlonan |
| 6,357,077 | B1 | 3/2002 | Jones, Jr. et al. |
| 6,361,476 | B1 | 3/2002 | Eschenbach |
| 6,368,252 | B1 | 4/2002 | Stearns |
| 6,368,254 | B1 | 4/2002 | Wall |
| 6,371,738 | B2 | 4/2002 | Jones |
| 6,371,895 | B1 | 4/2002 | Endelman et al. |
| 6,375,580 | B1 | 4/2002 | Schmidt |
| 6,379,289 | B1 | 4/2002 | Gossie |
| 6,382,627 | B1 | 5/2002 | Lundberg |
| 6,383,120 | B1 | 5/2002 | Lo |
| 6,387,015 | B1 | 5/2002 | Watson |
| 6,387,016 | B1 | 5/2002 | Lo |
| 6,390,953 | B1 | 5/2002 | Maresh |
| 6,390,955 | B1 | 5/2002 | Wang |
| 6,394,239 | B1 | 5/2002 | Carlson |
| 6,397,797 | B1 | 6/2002 | Kolmanovsky et al. |
| 6,398,695 | B2 | 6/2002 | Miller |
| 6,402,666 | B2 | 6/2002 | Krull |
| 6,409,632 | B1 | 6/2002 | Eschenbach |
| 6,409,633 | B1 | 6/2002 | Abelbeck |
| 6,413,197 | B2 | 7/2002 | McKechnie et al. |

(56) References Cited

U.S. PATENT DOCUMENTS

| | | | |
|---|---|---|---|
| 6,416,442 | B1 | 7/2002 | Stearns et al. |
| 6,416,444 | B1 | 7/2002 | Lim |
| 6,419,611 | B1 | 7/2002 | Levine et al. |
| 6,422,976 | B1 | 7/2002 | Eschenbach |
| 6,422,977 | B1 | 7/2002 | Eschenbach |
| 6,422,983 | B1 | 7/2002 | Weck |
| 6,428,449 | B1 | 8/2002 | Apseloff |
| 6,430,997 | B1 | 8/2002 | French et al. |
| 6,432,026 | B1 | 8/2002 | Wang |
| 6,435,466 | B1 | 8/2002 | Adams |
| 6,436,007 | B1 | 8/2002 | Eschenbach |
| 6,436,008 | B1 | 8/2002 | Skowronski et al. |
| 6,440,013 | B1 | 8/2002 | Brown |
| 6,440,042 | B2 | 8/2002 | Eschenbach |
| 6,443,875 | B1 | 9/2002 | Golen, Jr. et al. |
| 6,447,430 | B1 | 9/2002 | Webb et al. |
| 6,450,284 | B1 | 9/2002 | Sakyo et al. |
| 6,450,922 | B1 | 9/2002 | Henderson et al. |
| 6,450,923 | B1 | 9/2002 | Vatti |
| 6,450,925 | B1 | 9/2002 | Kuo |
| 6,454,679 | B1 | 9/2002 | Radow |
| 6,454,682 | B1 | 9/2002 | Kuo |
| 6,455,960 | B1 | 9/2002 | Trago et al. |
| 6,458,060 | B1 | 10/2002 | Watterson et al. |
| 6,461,275 | B1 | 10/2002 | Wang et al. |
| 6,461,279 | B1 | 10/2002 | Kuo |
| 6,466,460 | B1 | 10/2002 | Rein et al. |
| 6,468,189 | B2 | 10/2002 | Alessandri |
| 6,471,622 | B1 | 10/2002 | Hammer et al. |
| 6,475,121 | B2 | 11/2002 | Wang |
| 6,478,721 | B1 | 11/2002 | Hunter |
| 6,482,128 | B1 | 11/2002 | Michalow |
| 6,482,130 | B1 | 11/2002 | Pasero et al. |
| 6,482,132 | B2 | 11/2002 | Eschenbach |
| 6,485,397 | B1 | 11/2002 | Manderbacka |
| 6,488,020 | B1 | 12/2002 | Rosas-Magallan |
| 6,491,610 | B1 | 12/2002 | Henn |
| 6,494,814 | B1 | 12/2002 | Wang |
| 6,494,817 | B2 | 12/2002 | Lake |
| 6,500,097 | B1 | 12/2002 | Hall |
| 6,503,173 | B2 | 1/2003 | Clem |
| 6,505,503 | B1 | 1/2003 | Teresi et al. |
| 6,513,669 | B2 | 2/2003 | Ozawa et al. |
| 6,514,180 | B1 | 2/2003 | Rawls |
| 6,520,891 | B1 | 2/2003 | Stephens, Jr. |
| 6,527,674 | B1 | 3/2003 | Clem |
| 6,527,678 | B1 | 3/2003 | Wang |
| 6,527,685 | B2 | 3/2003 | Endelman et al. |
| 6,527,796 | B1 | 3/2003 | Magovern |
| 6,530,864 | B1 | 3/2003 | Parks |
| 6,533,707 | B2 | 3/2003 | Wang |
| 6,537,184 | B2 | 3/2003 | Kim |
| 6,543,247 | B2 | 4/2003 | Strauss |
| 6,544,146 | B1 | 4/2003 | Stearns et al. |
| 6,547,701 | B1 | 4/2003 | Eschenbach |
| 6,547,702 | B1 | 4/2003 | Heidecke |
| 6,551,218 | B2 | 4/2003 | Goh |
| 6,551,223 | B2 | 4/2003 | Cheng |
| 6,554,749 | B2 | 4/2003 | Iund et al. |
| 6,558,299 | B1 | 5/2003 | Slattery |
| 6,558,301 | B1 | 5/2003 | Jackson |
| 6,561,960 | B2 | 5/2003 | Webber |
| 6,563,489 | B1 | 5/2003 | Latypov et al. |
| 6,569,061 | B2 | 5/2003 | Stearns et al. |
| 6,569,062 | B2 | 5/2003 | Wang |
| 6,572,511 | B1 | 6/2003 | Volpe |
| 6,572,512 | B2 | 6/2003 | Anderson et al. |
| 6,572,513 | B1 | 6/2003 | Whan-Tong et al. |
| 6,575,878 | B1 | 6/2003 | Choy |
| 6,579,210 | B1 | 6/2003 | Stearns et al. |
| 6,582,342 | B2 | 6/2003 | Kaufman |
| 6,582,344 | B2 | 6/2003 | Tang |
| 6,585,624 | B1 | 7/2003 | Chen |
| 6,585,626 | B2 | 7/2003 | McBride |
| 6,589,138 | B2 | 7/2003 | Dyer et al. |
| 6,592,502 | B1 | 7/2003 | Phillips |
| 6,599,223 | B2 | 7/2003 | Wang |
| 6,601,016 | B1 | 7/2003 | Brown et al. |
| 6,601,358 | B2 | 8/2003 | Panatta |
| 6,601,825 | B2 | 8/2003 | Bressner et al. |
| 6,604,008 | B2 | 8/2003 | Chudley et al. |
| 6,605,020 | B1 | 8/2003 | Huang |
| 6,609,478 | B2 | 8/2003 | Del Valle |
| 6,610,063 | B2 | 8/2003 | Kumar et al. |
| 6,612,969 | B2 | 9/2003 | Eschenbach |
| 6,612,971 | B1 | 9/2003 | Morris |
| 6,619,681 | B2 | 9/2003 | Gutierrez |
| 6,620,079 | B2 | 9/2003 | Kuo |
| 6,623,407 | B2 | 9/2003 | Novak |
| 6,623,409 | B1 | 9/2003 | Abelbeck |
| 6,626,799 | B2 | 9/2003 | Watterson et al. |
| 6,626,802 | B1 | 9/2003 | Rodgers, Jr. |
| 6,626,803 | B1 | 9/2003 | Oglesby et al. |
| 6,629,902 | B2 | 10/2003 | Murphy et al. |
| 6,629,910 | B1 | 10/2003 | Krull |
| 6,632,161 | B1 | 10/2003 | Nir |
| 6,634,996 | B2 | 10/2003 | Jacobsen |
| 6,637,811 | B2 | 10/2003 | Zheng |
| 6,637,818 | B2 | 10/2003 | Williams |
| 6,645,125 | B1 | 11/2003 | Stearns et al. |
| 6,645,126 | B1 | 11/2003 | Martin et al. |
| 6,645,130 | B2 | 11/2003 | Webber |
| 6,648,800 | B2 | 11/2003 | Stearns et al. |
| 6,648,801 | B2 | 11/2003 | Stearns et al. |
| 6,648,802 | B2 | 11/2003 | Ware |
| 6,652,424 | B2 | 11/2003 | Dalebout |
| 6,652,425 | B1 | 11/2003 | Martin et al. |
| 6,652,429 | B2 | 11/2003 | Bushnell |
| 6,660,949 | B2 | 12/2003 | Kamino et al. |
| 6,661,136 | B1 | 12/2003 | Lee |
| 6,663,127 | B2 | 12/2003 | Miller |
| 6,663,498 | B2 | 12/2003 | Stipan |
| 6,663,500 | B2 | 12/2003 | Huang |
| 6,666,800 | B2 | 12/2003 | Krull |
| 6,666,801 | B1 | 12/2003 | Michalow |
| 6,668,678 | B1 | 12/2003 | Baba et al. |
| 6,669,600 | B2 | 12/2003 | Warner |
| 6,669,609 | B2 | 12/2003 | Gerschefske et al. |
| 6,671,975 | B2 | 1/2004 | Hennessey |
| 6,672,991 | B2 | 1/2004 | O'Malley |
| 6,672,992 | B1 | 1/2004 | Lo et al. |
| 6,672,994 | B1 | 1/2004 | Stearns et al. |
| 6,676,530 | B2 | 1/2004 | Lochtefeld |
| 6,676,572 | B2 | 1/2004 | Wang |
| 6,676,579 | B1 | 1/2004 | Lin |
| 6,679,816 | B1 | 1/2004 | Krull |
| 6,679,820 | B2 | 1/2004 | Barkus et al. |
| 6,681,704 | B1 | 1/2004 | Brookhiser |
| 6,681,728 | B2 | 1/2004 | Haghgooie |
| 6,682,460 | B2 | 1/2004 | Lo |
| 6,682,461 | B2 | 1/2004 | Wang |
| 6,685,601 | B1 | 2/2004 | Knapp |
| 6,685,602 | B2 | 2/2004 | Colosky, Jr. et al. |
| 6,685,607 | B1 | 2/2004 | Olson |
| 6,689,019 | B2 | 2/2004 | Ohrt et al. |
| 6,695,694 | B2 | 2/2004 | Ishikawa et al. |
| 6,698,110 | B1 | 3/2004 | Robbins |
| 6,699,159 | B2 | 3/2004 | Rouse |
| 6,699,162 | B2 | 3/2004 | Chen |
| 6,702,719 | B1 | 3/2004 | Brown et al. |
| 6,705,977 | B1 | 3/2004 | Ziak |
| 6,708,427 | B2 | 3/2004 | Sussmann et al. |
| 6,712,737 | B1 | 3/2004 | Nusbaum |
| 6,716,142 | B2 | 4/2004 | Kuo |
| 6,716,144 | B1 | 4/2004 | Shifferaw |
| 6,719,667 | B2 | 4/2004 | Wong et al. |
| 6,719,669 | B1 | 4/2004 | Wang |
| 6,723,413 | B2 | 4/2004 | Walters |
| 6,726,600 | B2 | 4/2004 | Miller |
| 6,726,601 | B1 | 4/2004 | Beutel |
| 6,726,602 | B2 | 4/2004 | Chang |
| 6,730,002 | B2 | 5/2004 | Hald et al. |
| 6,733,423 | B1 | 5/2004 | Chang |
| 6,733,424 | B2 | 5/2004 | Krull |

(56) References Cited

U.S. PATENT DOCUMENTS

| | | | |
|---|---|---|---|
| 6,736,360 | B1 | 5/2004 | Buczek |
| 6,738,274 | B2 | 5/2004 | Prasad et al. |
| 6,740,009 | B1 | 5/2004 | Hall |
| 6,741,052 | B2 | 5/2004 | Fitzgibbon |
| 6,743,153 | B2 | 6/2004 | Watterson et al. |
| 6,746,371 | B1 | 6/2004 | Brown et al. |
| 6,747,427 | B1 | 6/2004 | Carson |
| 6,749,542 | B2 | 6/2004 | Wu |
| 6,758,790 | B1 | 7/2004 | Ellis |
| 6,758,791 | B1 | 7/2004 | Kuo |
| 6,758,792 | B1 | 7/2004 | Chang |
| 6,761,387 | B2 | 7/2004 | Sloss |
| 6,761,667 | B1 | 7/2004 | Cutler et al. |
| 6,764,429 | B1 | 7/2004 | Michalow |
| 6,764,430 | B1 | 7/2004 | Fencel |
| 6,764,431 | B2 | 7/2004 | Yoss |
| 6,765,726 | B2 | 7/2004 | French et al. |
| 6,767,314 | B2 | 7/2004 | Thompson |
| 6,770,015 | B2 | 8/2004 | Simonson |
| 6,776,740 | B1 | 8/2004 | Anderson et al. |
| 6,778,938 | B1 | 8/2004 | Ng et al. |
| 6,783,482 | B2 | 8/2004 | Oglesby et al. |
| 6,786,821 | B2 | 9/2004 | Nobe et al. |
| 6,786,847 | B1 | 9/2004 | Morgan et al. |
| 6,786,848 | B2 | 9/2004 | Yamashita et al. |
| 6,786,850 | B2 | 9/2004 | Nizamuddin |
| 6,786,852 | B2 | 9/2004 | Watterson et al. |
| 6,790,162 | B1 | 9/2004 | Ellis et al. |
| 6,793,607 | B2 | 9/2004 | Neil |
| 6,793,609 | B1 | 9/2004 | Fan |
| 6,796,159 | B2 | 9/2004 | Kelm et al. |
| 6,796,927 | B2 | 9/2004 | Toyama |
| 6,808,458 | B1 | 10/2004 | Jung |
| 6,808,475 | B2 | 10/2004 | Kehrbaum |
| 6,811,519 | B2 | 11/2004 | Kuo |
| 6,811,520 | B2 | 11/2004 | Wu |
| 6,817,117 | B1 | 11/2004 | Campbell |
| 6,817,968 | B2 | 11/2004 | Galbraith et al. |
| 6,821,230 | B2 | 11/2004 | Dalebout et al. |
| 6,824,210 | B2 | 11/2004 | Zheng |
| 6,824,502 | B1 | 11/2004 | Huang |
| 6,830,540 | B2 | 12/2004 | Watterson et al. |
| 6,830,541 | B2 | 12/2004 | Wu |
| 6,835,166 | B1 | 12/2004 | Stearns et al. |
| 6,837,829 | B2 | 1/2005 | Eschenbach |
| 6,837,830 | B2 | 1/2005 | Eldridge |
| 6,837,838 | B2 | 1/2005 | List |
| 6,840,892 | B1 | 1/2005 | Wu |
| 6,842,928 | B2 | 1/2005 | Yang et al. |
| 6,843,732 | B1 | 1/2005 | Huang |
| 6,846,272 | B2 | 1/2005 | Rosenow et al. |
| 6,849,032 | B2 | 2/2005 | Chu |
| 6,852,068 | B2 | 2/2005 | Ogawa |
| 6,855,093 | B2 | 2/2005 | Anderson et al. |
| 6,855,097 | B2 | 2/2005 | Krull |
| 6,857,993 | B2 | 2/2005 | Yeh |
| 6,860,836 | B1 | 3/2005 | Wu |
| 6,860,839 | B1 | 3/2005 | Dice |
| 6,872,168 | B2 | 3/2005 | Wang et al. |
| 6,872,175 | B2 | 3/2005 | Lin |
| 6,875,157 | B1 | 4/2005 | Wang |
| 6,875,160 | B2 | 4/2005 | Watterson et al. |
| 6,878,101 | B2 | 4/2005 | Colley |
| 6,880,487 | B2 | 4/2005 | Reinkensmeyer et al. |
| 6,881,176 | B2 | 4/2005 | Oishi et al. |
| 6,887,185 | B1 | 5/2005 | Kuo |
| 6,887,190 | B1 | 5/2005 | Azari |
| 6,893,383 | B1 | 5/2005 | Chang et al. |
| 6,896,645 | B1 | 5/2005 | Krull |
| 6,899,657 | B2 | 5/2005 | Chuang |
| 6,899,659 | B2 | 5/2005 | Anderson et al. |
| 6,902,513 | B1 | 6/2005 | Mcclure |
| 6,902,515 | B2 | 6/2005 | Howell et al. |
| 6,905,446 | B2 | 6/2005 | Greenland |
| 6,908,416 | B2 | 6/2005 | Mercado et al. |
| 6,908,417 | B2 | 6/2005 | Jackson |
| 6,913,562 | B2 | 7/2005 | Chen |
| 6,913,563 | B2 | 7/2005 | Chen |
| 6,916,278 | B2 | 7/2005 | Webber |
| 6,918,858 | B2 | 7/2005 | Watterson et al. |
| 6,918,859 | B1 | 7/2005 | Yeh |
| 6,918,860 | B1 | 7/2005 | Nusbaum |
| 6,921,354 | B1 | 7/2005 | Shifferaw |
| 6,921,355 | B2 | 7/2005 | Campanaro et al. |
| 6,923,746 | B1 | 8/2005 | Skowronski et al. |
| 6,923,747 | B1 | 8/2005 | Chu |
| 6,926,644 | B2 | 8/2005 | Chen |
| 6,926,646 | B1 | 8/2005 | Nguyen |
| 6,932,745 | B1 | 8/2005 | Ellis |
| 6,939,271 | B1 | 9/2005 | Whan-Tong et al. |
| 6,944,294 | B2 | 9/2005 | Tsay |
| 6,945,912 | B2 | 9/2005 | Levi |
| 6,945,917 | B1 | 9/2005 | Baatz |
| 6,949,053 | B1 | 9/2005 | Stearns |
| 6,949,054 | B1 | 9/2005 | Stearns |
| 6,953,418 | B1 | 10/2005 | Chen |
| 6,964,632 | B1 | 11/2005 | Ko |
| 6,966,872 | B2 | 11/2005 | Eschenbach |
| 6,974,404 | B1 | 12/2005 | Watterson et al. |
| 6,976,698 | B2 | 12/2005 | Kuiken |
| 6,979,283 | B2 | 12/2005 | Pan |
| 6,991,588 | B1 | 1/2006 | Adams |
| 6,994,306 | B1 | 2/2006 | Sweere et al. |
| 6,994,657 | B1 | 2/2006 | Eschenbach |
| 6,997,852 | B2 | 2/2006 | Watterson et al. |
| 6,997,856 | B1 | 2/2006 | Krull |
| 7,001,288 | B2 | 2/2006 | Harrell |
| 7,003,122 | B2 | 2/2006 | Chen |
| 7,004,271 | B1 | 2/2006 | Kamen et al. |
| 7,004,887 | B2 | 2/2006 | Pan et al. |
| 7,004,888 | B1 | 2/2006 | Weng |
| 7,004,895 | B2 | 2/2006 | Perry |
| 7,008,359 | B2 | 3/2006 | Fan et al. |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,022,047 | B2 | 4/2006 | Cohen et al. |
| 7,022,048 | B1 | 4/2006 | Fernandez |
| 7,022,049 | B2 | 4/2006 | Ryan et al. |
| 7,022,051 | B2 | 4/2006 | Ota |
| 7,032,870 | B2 | 4/2006 | Sweere et al. |
| 7,033,176 | B2 | 4/2006 | Feldman |
| 7,033,306 | B2 | 4/2006 | Graber |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,044,891 | B1 | 5/2006 | Rivera |
| 7,052,426 | B2 | 5/2006 | Battat et al. |
| 7,052,440 | B2 | 5/2006 | Pyles et al. |
| 7,052,444 | B2 | 5/2006 | Webber |
| 7,052,446 | B2 | 5/2006 | Morris et al. |
| 7,055,899 | B2 | 6/2006 | Zhurong et al. |
| 7,060,005 | B2 | 6/2006 | Carlsen et al. |
| 7,060,006 | B1 | 6/2006 | Watterson et al. |
| 7,070,542 | B2 | 7/2006 | Reyes et al. |
| 7,070,545 | B2 | 7/2006 | Lull et al. |
| 7,073,852 | B1 | 7/2006 | Zheng |
| 7,077,788 | B2 | 7/2006 | Chang |
| 7,077,791 | B2 | 7/2006 | Krull |
| 7,081,073 | B1 | 7/2006 | Smith |
| 7,082,703 | B2 | 8/2006 | Greene et al. |
| 7,086,994 | B2 | 8/2006 | Turak et al. |
| 7,090,621 | B2 | 8/2006 | Loane |
| 7,090,622 | B2 | 8/2006 | Hetrick |
| 7,097,591 | B2 | 8/2006 | Moon |
| 7,097,593 | B2 | 8/2006 | Chang |
| 7,100,517 | B1 | 9/2006 | Godwin |
| 7,101,319 | B1 | 9/2006 | Potts |
| 7,101,322 | B2 | 9/2006 | Carle |
| 7,101,330 | B2 | 9/2006 | Elbaz et al. |
| 7,104,926 | B2 | 9/2006 | Carlson |
| 7,104,937 | B2 | 9/2006 | Arbuckle |
| 7,108,641 | B2 | 9/2006 | Pertegaz-Esteban |

(56) References Cited

U.S. PATENT DOCUMENTS 7,108,659 B2 9/2006 Ross et al.
7,115,073 B2 10/2006 Nizamuddin
7,125,371 B2 10/2006 Henderson
7,132,939 B2 11/2006 Tyndall et al.
7,140,626 B1 11/2006 Keay
7,141,008 B2 11/2006 Krull et al.
7,156,776 B2 1/2007 Maser
7,163,493 B1 1/2007 Kuo
7,163,498 B1 1/2007 Abelbeck
7,163,500 B2 1/2007 Endelman et al.
7,166,062 B1 1/2007 Watterson et al.
7,166,064 B2 1/2007 Watterson et al.
7,166,067 B2 1/2007 Talish et al.
7,168,668 B2 1/2007 Coyle
7,169,087 B2 1/2007 Ercanbrack et al.
7,169,088 B2 1/2007 Rodgers, Jr.
7,172,531 B2 2/2007 Rodgers, Jr.
7,175,193 B2 2/2007 Wu
7,179,207 B2 2/2007 Gerschefske
7,179,208 B1 2/2007 Nalley
7,179,209 B2 2/2007 Sechrest et al.
7,186,189 B2 3/2007 Huang
7,192,387 B2 3/2007 Mendel
7,192,388 B2 3/2007 Dalebout et al.
7,195,568 B2 3/2007 Huang
7,201,705 B2 4/2007 Rodgers, Jr.
7,201,707 B1 4/2007 Moon
7,204,328 B2 4/2007 LoPresti
7,211,029 B2 5/2007 Kau
7,217,224 B2 5/2007 Thomas
7,217,225 B2 5/2007 Husted et al.
7,220,219 B2 5/2007 Papadopoulos et al.
7,220,221 B2 5/2007 Mosimann et al.
7,223,209 B2 5/2007 Lee
7,223,216 B1 5/2007 McBride
7,225,694 B2 6/2007 Said
7,226,402 B1 6/2007 Joya
7,235,942 B2 6/2007 Nagaoka et al.
7,238,147 B2 7/2007 Mills et al.
7,247,128 B2 7/2007 Oga
7,250,022 B2 7/2007 Dalebout
7,257,468 B1 8/2007 Costa et al.
7,258,651 B2 8/2007 Clarke
7,264,554 B2 9/2007 Bentley
7,269,038 B2 9/2007 Shekhawat
7,278,934 B2 10/2007 McBride et al.
7,278,955 B2 10/2007 Giannelli et al.
7,278,966 B2 10/2007 Hjelt et al.
7,279,868 B2 10/2007 Lanni
7,285,075 B2 10/2007 Cutler et al.
7,287,770 B2 10/2007 Drabant et al.
7,290,760 B1 11/2007 Lindsay
7,291,096 B2 11/2007 Ho
7,292,151 B2 11/2007 Ferguson
7,293,510 B1 11/2007 Siao
7,294,094 B1 11/2007 Howle
7,294,100 B2 11/2007 Bull
7,303,508 B2 12/2007 Toyama et al.
7,303,510 B2 12/2007 Gebhardt
7,311,640 B2 12/2007 Baatz
7,316,633 B2 1/2008 Liao et al.
7,319,457 B2 1/2008 Lin et al.
7,322,907 B2 1/2008 Bowser
7,334,350 B2 2/2008 Ellis, III
7,335,139 B2 2/2008 Bartholomew et al.
7,335,140 B2 2/2008 Webber et al.
7,335,147 B2 2/2008 Jones
7,344,481 B2 * 3/2008 Watterson ..... A63B 22/02 482/4
7,346,935 B1 3/2008 Patterson
7,347,806 B2 3/2008 Nakano et al.
7,351,187 B2 4/2008 Seliber
7,352,365 B2 4/2008 Trachte
7,354,380 B2 4/2008 Volpe, Jr.
7,357,756 B2 4/2008 Demas
7,357,758 B2 4/2008 Polk, III
7,359,121 B2 4/2008 French et al.
7,361,125 B2 4/2008 Webber et al.
7,364,538 B2 4/2008 Aucamp
7,366,921 B2 4/2008 Ranganathan
7,367,926 B2 5/2008 Clark
7,369,121 B2 5/2008 Lane
7,374,522 B2 5/2008 Arnold
7,384,013 B2 6/2008 Yen
7,393,308 B1 7/2008 Huang
7,402,145 B1 7/2008 Woggon
7,413,532 B1 8/2008 Monsrud et al.
7,425,189 B1 9/2008 Eschenbach
7,428,760 B2 9/2008 McCrimmon
7,429,236 B2 9/2008 Dalebout et al.
7,432,677 B2 10/2008 Heydt et al.
7,435,202 B2 10/2008 Daly et al.
7,435,205 B2 10/2008 Reyes et al.
7,455,621 B1 11/2008 Anthony
7,455,626 B2 11/2008 Trevino et al.
7,455,628 B1 11/2008 Stearns
7,470,234 B1 12/2008 Elhag et al.
7,475,613 B2 1/2009 Bailey
7,488,277 B1 2/2009 Knapp
7,494,450 B2 2/2009 Solomon
7,497,784 B2 3/2009 Henry
7,507,187 B2 3/2009 Dyer et al.
7,507,189 B2 3/2009 Krull
7,510,511 B2 3/2009 Von Detten
7,517,303 B2 4/2009 Crawford et al.
7,520,840 B2 4/2009 Shifferaw
7,524,272 B2 4/2009 Bruck et al.
7,525,293 B1 4/2009 Notohamiprodjo et al.
7,537,546 B2 5/2009 Watterson et al.
7,537,549 B2 5/2009 Nelson et al.
7,537,550 B1 5/2009 Krull
7,540,828 B2 6/2009 Watterson et al.
7,540,829 B1 6/2009 Lin
7,542,040 B2 6/2009 Templeman
7,544,153 B2 6/2009 Trevino et al.
7,553,260 B2 6/2009 Piaget et al.
7,553,262 B2 6/2009 Piane, Jr.
7,556,590 B2 7/2009 Watterson et al.
7,556,591 B2 7/2009 Chuang
7,559,879 B2 7/2009 Anderson et al.
7,563,203 B2 7/2009 Dalebout et al.
7,563,205 B2 7/2009 Alling
7,569,000 B2 8/2009 Wang
7,569,004 B2 8/2009 Kolomeir
7,572,206 B2 8/2009 Wilkins et al.
7,575,537 B2 8/2009 Ellis
7,585,251 B2 9/2009 Doody, Jr. et al.
7,585,254 B1 9/2009 Vittone
7,585,258 B2 9/2009 Watson et al.
7,591,770 B2 9/2009 Stewart et al.
7,591,795 B2 9/2009 Whalen et al.
7,594,877 B2 9/2009 Anderson et al.
7,594,878 B1 9/2009 Joannou
7,601,101 B2 10/2009 Jackson et al.
7,602,301 B1 10/2009 Stirling et al.
7,604,571 B2 10/2009 Wilkins et al.
7,604,572 B2 10/2009 Stanford
7,604,573 B2 10/2009 Dalebout et al.
7,608,015 B2 10/2009 Radow
7,608,021 B1 10/2009 Nalley
7,608,023 B2 10/2009 Casagrande
7,614,639 B2 11/2009 Tholkes et al.
7,614,981 B2 11/2009 Cao
7,618,346 B2 11/2009 Crawford et al.
7,621,850 B2 11/2009 Piaget et al.
7,621,855 B1 11/2009 Krull
7,625,314 B2 12/2009 Ungari
7,628,730 B1 12/2009 Watterson et al.
7,628,732 B1 12/2009 Porszasz et al.
7,637,847 B1 12/2009 Hickman
7,637,850 B2 12/2009 Lin
7,639,520 B1 12/2009 Zansky et al.
7,645,212 B2 1/2010 Ashby et al.
7,645,214 B2 1/2010 Lull

(56) References Cited

U.S. PATENT DOCUMENTS 7,645,218 B2 1/2010 Potok et al.
7,647,196 B2 1/2010 Kahn et al.
7,648,446 B2 1/2010 Chiles et al.
7,651,442 B2 1/2010 Carlson
7,654,229 B2 2/2010 Smith
7,658,694 B2 2/2010 Ungari
7,658,695 B1 2/2010 Amsbury et al.
7,658,698 B2 2/2010 Pacheco et al.
7,670,263 B2 3/2010 Ellis
7,674,205 B2 3/2010 Dalebout et al.
7,674,206 B2 3/2010 Jones
7,677,518 B2 3/2010 Chouinard et al.
7,682,286 B2 3/2010 Badarneh et al.
7,682,287 B1 3/2010 Hsieh
7,682,290 B2 3/2010 Liao et al.
7,682,291 B2 3/2010 Gill et al.
7,690,556 B1 4/2010 Kahn et al.
7,695,409 B2 4/2010 Helie et al.
7,704,191 B2 4/2010 Smith et al.
7,704,192 B2 4/2010 Dyer et al.
7,708,668 B2 5/2010 Rodgers, Jr.
7,708,672 B2 5/2010 Gibson et al.
7,713,172 B2 5/2010 Watterson et al.
7,713,177 B2 5/2010 Lo
7,717,826 B2 5/2010 Cox et al.
7,717,827 B2 5/2010 Kurunmäki et al.
7,717,828 B2 5/2010 Simonson et al.
7,717,830 B1 5/2010 Charniga et al.
7,722,503 B1 5/2010 Smith et al.
7,722,509 B2 5/2010 Eder
7,731,634 B2 6/2010 Stewart et al.
7,736,272 B2 6/2010 Martens
7,736,273 B2 6/2010 Cox et al.
7,736,279 B2 6/2010 Dalebout et al.
7,736,280 B2 6/2010 Weier et al.
7,736,281 B2 6/2010 Corbalis et al.
7,740,563 B2 6/2010 Dalebout et al.
7,745,716 B1 6/2010 Murphy
7,749,137 B2 7/2010 Watt et al.
7,753,830 B1 7/2010 Marsh et al.
7,753,861 B1 7/2010 Kahn et al.
7,758,469 B2 7/2010 Dyer et al.
7,762,952 B2 7/2010 Lee et al.
7,766,797 B2 8/2010 Dalebout
7,771,319 B1 8/2010 Lannon
7,771,320 B2 8/2010 Riley et al.
7,771,329 B2 8/2010 Dalebout et al.
7,775,128 B2 8/2010 Roessingh et al.
7,775,936 B2 8/2010 Wilkinson
7,775,943 B2 8/2010 Vittone
7,780,578 B2 8/2010 Packham
7,789,800 B1 9/2010 Watterson et al.
7,794,363 B2 9/2010 Wang
7,795,824 B2 9/2010 Shen et al.
7,806,780 B1 10/2010 Plunkett
7,806,805 B2 10/2010 Barufka et al.
7,811,209 B2 10/2010 Crawford et al.
7,815,549 B2 10/2010 Crawford et al.
7,815,550 B2 10/2010 Watterson et al.
7,815,554 B2 10/2010 Gibson et al.
7,837,161 B2 11/2010 Chase
7,837,595 B2 11/2010 Rice
7,839,058 B1 11/2010 Churchill et al.
7,846,070 B2 12/2010 Oglesby et al.
7,862,483 B2 1/2011 Hendrickson et al.
7,871,355 B2 1/2011 Yeh
7,871,357 B2 1/2011 Gibson
7,878,950 B1 2/2011 Bastian
7,883,448 B2 2/2011 Wang
7,887,465 B2 2/2011 Uffelman
7,892,148 B1 2/2011 Stauffer et al.
7,892,149 B2 2/2011 Wu
7,892,150 B1 2/2011 Colley
7,901,325 B2 3/2011 Henderson
7,908,981 B2 3/2011 Agee
7,914,420 B2 3/2011 Daly et al.
7,914,421 B2 3/2011 Weier et al.
7,919,950 B2 4/2011 Uno et al.
7,922,635 B2 4/2011 Lull et al.
7,927,253 B2 4/2011 Vincent
7,931,563 B2 4/2011 Shaw et al.
7,938,751 B2 5/2011 Nicolas et al.
7,938,755 B1 5/2011 Dyer et al.
7,942,783 B2 * 5/2011 Ochi ..... A61H 1/0244 482/1
7,942,788 B2 5/2011 Wu
7,946,968 B2 5/2011 Kjellberg
7,949,295 B2 5/2011 Kumar et al.
7,951,046 B1 5/2011 Barber, Jr.
7,959,124 B2 6/2011 Phifer et al.
7,972,249 B1 7/2011 Napalan
7,976,437 B1 7/2011 Von Detten
7,978,081 B2 7/2011 Shears et al.
7,985,164 B2 7/2011 Ashby
7,988,600 B2 8/2011 Rodgers, Jr.
8,001,472 B2 8/2011 Gilley et al.
8,002,674 B2 8/2011 Piaget et al.
8,002,684 B2 8/2011 Laurent
8,007,409 B2 8/2011 Elllis
8,012,067 B2 9/2011 Joannou
8,012,068 B1 9/2011 Malcolm
8,029,415 B2 10/2011 Ashby et al.
8,043,173 B2 10/2011 Menalagha et al.
8,047,965 B2 11/2011 Shea
8,047,966 B2 11/2011 Dorogusker et al.
8,047,970 B2 11/2011 Nalley
8,055,469 B2 11/2011 Kulach et al.
8,057,368 B1 11/2011 Lyszczarz
8,062,196 B1 11/2011 Khubani
8,066,514 B2 11/2011 Clarke
8,079,939 B1 12/2011 Wang
8,082,029 B2 12/2011 Honda
8,083,693 B1 12/2011 McKeon et al.
8,103,379 B2 1/2012 Biba et al.
8,104,411 B2 1/2012 Fenton
8,105,213 B2 1/2012 Stewart et al.
8,109,858 B2 2/2012 Redmann
8,113,994 B2 2/2012 Piaget et al.
8,123,527 B2 2/2012 Holljes
8,141,276 B2 3/2012 Ellis
8,147,385 B2 4/2012 Crawford et al.
8,162,804 B2 4/2012 Tagliabue
8,172,729 B2 5/2012 Ellis
8,177,688 B2 5/2012 Burnfield et al.
8,182,399 B2 5/2012 Davis et al.
8,188,700 B2 5/2012 Tseng et al.
8,200,323 B2 6/2012 Dibenedetto et al.
8,221,290 B2 7/2012 Vincent et al.
8,221,295 B2 * 7/2012 Wilkins ..... A63B 5/00 482/130
8,240,430 B2 8/2012 Downey
8,241,187 B2 8/2012 Moon et al.
8,251,874 B2 8/2012 Ashby et al.
8,260,858 B2 9/2012 Belz et al.
8,272,996 B2 9/2012 Weier
8,275,265 B2 9/2012 Kobyakov et al.
8,280,259 B2 10/2012 George et al.
8,287,434 B2 10/2012 Zavadsky et al.
8,306,635 B2 11/2012 Pryor
8,315,823 B2 11/2012 Berme et al.
8,320,578 B2 11/2012 Kahn et al.
8,323,157 B2 12/2012 Campanaro et al.
8,333,681 B2 12/2012 Schmidt
8,343,016 B1 1/2013 Astilean
8,360,904 B2 1/2013 Oleson et al.
8,360,935 B2 1/2013 Olsen et al.
8,360,936 B2 1/2013 Dibenedetto et al.
8,368,329 B1 2/2013 Depew et al.
8,378,647 B2 2/2013 Yonezawa et al.
8,394,005 B2 3/2013 Solow et al.
8,395,366 B2 3/2013 Uno
8,435,160 B1 5/2013 Clum
8,446,275 B2 5/2013 Utter, II
8,449,620 B2 5/2013 Hakansson et al.

(56) References Cited

U.S. PATENT DOCUMENTS 8,454,437 B2 6/2013 Dugan
8,459,479 B2 6/2013 Yourist
8,475,346 B2 7/2013 Gerschefske et al.
8,475,367 B1 7/2013 Yuen et al.
8,480,541 B1 7/2013 Brunts
8,485,944 B2 7/2013 Drazan
8,485,945 B2 7/2013 Leonhard
8,505,597 B2 8/2013 Sharperson
8,506,370 B2 8/2013 Homsi
8,512,210 B2 8/2013 Shauli
8,516,723 B2 8/2013 Ferrigan et al.
8,535,247 B2 9/2013 Williams
8,540,560 B2 9/2013 Crowley et al.
8,550,962 B2 10/2013 Piaget et al.
8,562,489 B2 10/2013 Burton et al.
8,573,982 B1 11/2013 Chuang
8,585,561 B2 11/2013 Watt et al.
8,602,951 B2 12/2013 Morris
8,608,624 B2 12/2013 Shabodyash et al.
8,614,595 B2 12/2013 Acatrinei
8,614,902 B2 12/2013 Pansier et al.
8,655,004 B2 2/2014 Prest et al.
8,657,724 B2 2/2014 Yang
8,690,578 B1 4/2014 Nusbaum et al.
8,690,735 B2 4/2014 Watterson et al.
8,690,738 B1 4/2014 Astilian
8,701,567 B1 4/2014 Esfandiari et al.
8,702,430 B2 4/2014 Dibenedetto et al.
8,702,567 B2 4/2014 Hu
8,708,870 B2 4/2014 Nalley
8,734,157 B1 5/2014 Hummel, III
8,734,301 B2 5/2014 Remelius
8,734,302 B2 5/2014 Hsieh
8,740,756 B2 6/2014 Shabodyash et al.
8,749,380 B2 6/2014 Vock et al.
8,758,201 B2 6/2014 Ashby et al.
8,762,101 B2 6/2014 Yuen et al.
8,764,609 B1 7/2014 Elahmadie
8,777,820 B2 7/2014 Lo
8,783,326 B1 7/2014 Vaninger et al.
8,784,274 B1 7/2014 Chuang
8,790,222 B2 7/2014 Burger
8,801,581 B2 8/2014 Lai et al.
8,824,697 B2 9/2014 Christoph
8,825,445 B2 9/2014 Hoffman et al.
8,847,988 B2 9/2014 Geisner et al.
8,851,565 B2 10/2014 Hontz et al.
8,864,627 B2 10/2014 Bayerlein et al.
8,876,661 B2 11/2014 Lu
8,888,660 B1 11/2014 Oteman
8,894,551 B2 11/2014 Kerdjoudj
8,920,291 B2 12/2014 Chen et al.
8,926,475 B2 1/2015 Lin et al.
8,926,479 B2 1/2015 Chen et al.
8,956,290 B2 2/2015 Gilley et al.
8,956,715 B2 2/2015 Kim
8,968,163 B1 3/2015 Vidmar
8,979,709 B2 3/2015 Toback et al.
8,986,165 B2 3/2015 Ashby
9,005,085 B2 4/2015 Astilean
9,011,291 B2 4/2015 Birrell
9,015,952 B2 4/2015 Magosaki
9,028,368 B2 5/2015 Ashby et al.
9,038,218 B1 5/2015 Heil et al.
9,039,578 B2 5/2015 Dalebout
9,050,491 B2 6/2015 Gordon et al.
9,050,498 B2 6/2015 Lu et al.
9,072,932 B2 7/2015 Piaget et al.
9,079,067 B2 * 7/2015 Huber ..... A63B 23/0233
9,089,732 B2 7/2015 Andon et al.
9,095,740 B2 8/2015 Wu
9,108,079 B2 8/2015 Solow et al.
9,114,275 B2 8/2015 Lu et al.
9,114,276 B2 8/2015 Bayerlein et al.
9,119,983 B2 9/2015 Rhea
9,132,051 B2 9/2015 Heil
9,138,614 B2 9/2015 Lu et al.
9,138,615 B2 9/2015 Olson et al.
9,144,703 B2 9/2015 Dalebout et al.
9,162,102 B1 10/2015 Eder et al.
9,162,106 B1 10/2015 Scheiman
9,168,414 B2 10/2015 Liu et al.
9,174,085 B2 11/2015 Foley
9,186,537 B2 11/2015 Arnold et al.
9,186,549 B2 11/2015 Watterson et al.
9,186,552 B1 11/2015 Deal
9,192,800 B1 11/2015 Meyer et al.
9,199,115 B2 12/2015 Yim et al.
9,199,123 B2 12/2015 Solow
9,201,458 B2 12/2015 Hunt et al.
9,220,940 B2 12/2015 Kuwari
9,221,545 B2 12/2015 Popescu et al.
9,224,291 B2 12/2015 Moll-Carrillo et al.
9,226,692 B2 1/2016 Haas
9,289,063 B2 3/2016 Baugh et al.
9,308,415 B2 4/2016 Crawford et al.
9,311,802 B1 4/2016 Chin et al.
9,333,388 B2 5/2016 Lee et al.
9,339,681 B1 5/2016 Nalley
9,339,683 B2 5/2016 Dilli et al.
9,352,185 B2 5/2016 Hendrickson et al.
9,352,186 B2 5/2016 Watterson
9,352,187 B2 5/2016 Piaget et al.
9,357,551 B2 5/2016 Gutman
9,358,422 B2 6/2016 Brontman
9,364,706 B2 6/2016 Lo
9,364,708 B2 6/2016 Luger et al.
9,364,714 B2 6/2016 Koduri et al.
9,367,668 B2 6/2016 Flynt et al.
9,370,687 B2 6/2016 Hao
9,387,387 B2 7/2016 Dalebout
9,389,718 B1 7/2016 Letourneur
9,409,050 B2 8/2016 Mintz
9,415,257 B2 8/2016 Habing
9,452,315 B1 9/2016 Murray et al.
9,452,320 B2 9/2016 Yang
9,455,784 B2 9/2016 Cune et al.
9,457,224 B2 10/2016 Giannelli et al.
9,463,349 B1 10/2016 Chang
9,480,874 B2 11/2016 Cutler
9,486,658 B2 11/2016 Alexander
9,498,671 B1 11/2016 Softky
9,505,241 B2 11/2016 Lyon
9,539,458 B1 1/2017 Ross
9,540,071 B2 1/2017 Jordan et al.
9,540,174 B2 1/2017 Josserond et al.
9,560,917 B2 2/2017 Roslund, Jr.
9,573,017 B2 2/2017 Chang
9,579,534 B2 2/2017 Sutkowski et al.
9,579,544 B2 2/2017 Watterson
9,582,976 B2 2/2017 Chin et al.
9,604,099 B2 3/2017 Taylor
9,610,475 B1 4/2017 DeKnock et al.
9,623,286 B1 4/2017 Chen
9,673,904 B2 6/2017 Palanisamy et al.
9,681,313 B2 6/2017 Malach
9,682,306 B2 6/2017 Lin et al.
9,694,234 B2 7/2017 Dalebout et al.
9,700,780 B2 7/2017 Riley et al.
9,707,441 B2 7/2017 Yang
9,707,447 B1 7/2017 Lopez Babodilla
9,731,158 B1 8/2017 Lo
9,737,747 B1 8/2017 Walsh et al.
9,757,605 B2 9/2017 Olson et al.
9,764,184 B2 9/2017 Kueker et al.
9,776,039 B1 10/2017 Xu
9,782,625 B1 10/2017 Blum et al.
9,795,827 B2 10/2017 Wiener et al.
9,808,673 B2 11/2017 Robinson
9,814,927 B2 11/2017 Forystek
9,814,929 B2 11/2017 Moser
9,814,930 B2 11/2017 Manzke et al.
9,814,936 B1 * 11/2017 Bucolo ..... A63B 24/0062
9,827,458 B2 11/2017 Dalton

(56) References Cited

U.S. PATENT DOCUMENTS 9,829,068 B2 11/2017 Marchetti
9,833,658 B2 12/2017 Wiener et al.
9,849,330 B2 12/2017 Lagree
9,889,334 B2 2/2018 Ashby et al.
9,901,767 B2 2/2018 Kuo
9,901,780 B2 2/2018 DeLuca et al.
9,901,805 B2 2/2018 Hughes, Jr.
9,914,011 B2 3/2018 Downey et al.
9,914,014 B2 3/2018 Lagree et al.
9,937,375 B2 4/2018 Zhu
9,943,719 B2 4/2018 Smith et al.
9,948,349 B2 4/2018 Malach
9,950,209 B2 4/2018 Yim et al.
9,956,450 B2 5/2018 Bayerlein et al.
9,968,821 B2 5/2018 Finlayson et al.
9,968,823 B2 5/2018 Cutler
9,987,513 B2 6/2018 Yim et al.
9,987,517 B1 6/2018 Kuo
9,993,680 B2 6/2018 Gordon
10,004,940 B2 6/2018 Badarneh
10,022,590 B2 7/2018 Foley et al.
2001/0001303 A1 5/2001 Ohsuga et al.
2001/0008053 A1 7/2001 Belli
2001/0049470 A1 12/2001 Mault et al.
2001/0051564 A1 12/2001 Iund
2002/0016235 A1 2/2002 Ashby et al.
2002/0019298 A1 2/2002 Eschenbach
2002/0024521 A1 2/2002 Goden
2002/0025888 A1 2/2002 Germanton
2002/0026130 A1 2/2002 West
2002/0039952 A1 4/2002 Clem
2002/0043909 A1 4/2002 Nielsen
2002/0045519 A1 4/2002 Watterson
2002/0055418 A1 5/2002 Pyles et al.
2002/0055419 A1 5/2002 Hinnebusch
2002/0055420 A1 5/2002 Stearns et al.
2002/0055422 A1 5/2002 Airmet
2002/0066735 A1 6/2002 Hewlitt et al.
2002/0077221 A1 6/2002 Dalebout et al.
2002/0094914 A1 7/2002 Maresh et al.
2002/0107058 A1 8/2002 Namba et al.
2002/0115536 A1 8/2002 Hojo
2002/0128127 A1 9/2002 Chen
2002/0147078 A1 10/2002 Wu
2002/0151413 A1 10/2002 Dalebout
2002/0160883 A1 10/2002 Dugan
2002/0171070 A1 11/2002 Shim
2002/0198084 A1 12/2002 Stearns et al.
2003/0032524 A1 2/2003 Lamar et al.
2003/0032535 A1 2/2003 Wang
2003/0045406 A1 3/2003 Stone
2003/0060344 A1 3/2003 David
2003/0069108 A1 4/2003 Rubinstein
2003/0073545 A1 4/2003 Liu
2003/0092532 A1 5/2003 Giannelli et al.
2003/0092540 A1 5/2003 Gillen
2003/0096675 A1 5/2003 Wang
2003/0097878 A1 5/2003 Farringdon et al.
2003/0104908 A1 6/2003 Tung
2003/0119635 A1 6/2003 Arbuckle
2003/0128186 A1 7/2003 Laker
2003/0134718 A1 7/2003 Kim
2003/0148853 A1 8/2003 Alessandri
2003/0171189 A1 9/2003 Kaufman
2003/0171190 A1 9/2003 Rice
2003/0176815 A1 9/2003 Baba et al.
2003/0181289 A1 9/2003 Oscar Moavro
2003/0183027 A1 10/2003 Koch
2003/0211916 A1 11/2003 Capuano
2003/0222419 A1 12/2003 Geary
2003/0236153 A1 12/2003 Pan et al.
2004/0005958 A1 1/2004 Kamen et al.
2004/0005961 A1 1/2004 Iund
2004/0014567 A1 1/2004 Mendel
2004/0014571 A1 1/2004 Haynes
2004/0018917 A1 1/2004 Corbalis
2004/0018918 A1 1/2004 Reyes
2004/0023759 A1 2/2004 Duncan et al.
2004/0023761 A1 2/2004 Emery
2004/0023762 A1 2/2004 Lull
2004/0023766 A1 2/2004 Slone
2004/0023778 A1 2/2004 Kusumoto et al.
2004/0025754 A1 2/2004 Dye
2004/0029645 A1 2/2004 Chen
2004/0033865 A1 2/2004 Wu
2004/0043871 A1 3/2004 Chang
2004/0043873 A1 3/2004 Wilkinson et al.
2004/0051392 A1 3/2004 Badarneh
2004/0053748 A1 3/2004 Lo et al.
2004/0063549 A1 4/2004 Kuo
2004/0067821 A1 4/2004 Kehrbaum
2004/0067833 A1 4/2004 Talish
2004/0082444 A1 4/2004 Golesh
2004/0092367 A1 5/2004 Corbalis
2004/0097331 A1 5/2004 Zillig
2004/0100484 A1 5/2004 Barrett
2004/0102292 A1 5/2004 Pyles et al.
2004/0103432 A1 5/2004 Barrett
2004/0114768 A1 6/2004 Luo
2004/0132586 A1 7/2004 Leighton et al.
2004/0132587 A1 7/2004 Leighton et al.
2004/0136750 A1 7/2004 Yoshioka et al.
2004/0138030 A1 7/2004 Wang
2004/0142800 A1 7/2004 Gerschefske
2004/0144626 A1 7/2004 Saeki
2004/0152566 A1 8/2004 Yeh
2004/0155622 A1 8/2004 Mayhew et al.
2004/0162189 A1 8/2004 Hickman
2004/0162191 A1 8/2004 Ercanbrack
2004/0163574 A1 8/2004 Schoenbach
2004/0166999 A1 8/2004 Dodge
2004/0171460 A1 9/2004 Park
2004/0171464 A1 9/2004 Ashby et al.
2004/0171465 A1 9/2004 Hald
2004/0176215 A1 9/2004 Gramaccioni
2004/0176217 A1 9/2004 Watterson
2004/0177531 A1 9/2004 Dibenedetto et al.
2004/0180719 A1 9/2004 Feldman
2004/0181972 A1 9/2004 Csorba
2004/0198555 A1 10/2004 Anderson
2004/0198559 A1 10/2004 Grossi
2004/0198571 A1 10/2004 Howell et al.
2004/0224740 A1 11/2004 Ball et al.
2004/0224825 A1 11/2004 Giannelli et al.
2004/0224827 A1 11/2004 Ashley
2004/0242378 A1 12/2004 Pan
2004/0242379 A1 12/2004 Juva
2004/0242380 A1 12/2004 Kuivala
2004/0248699 A1 12/2004 Colley
2004/0254020 A1 12/2004 Dragusin
2004/0256524 A1 12/2004 Beck et al.
2004/0266587 A1 12/2004 Miller
2005/0003931 A1 1/2005 Mills et al.
2005/0008992 A1 1/2005 Westergaard et al.
2005/0009668 A1 1/2005 Savettiere
2005/0023292 A1 2/2005 Market et al.
2005/0032611 A1 2/2005 Webber
2005/0037898 A1 2/2005 Chang
2005/0037904 A1 2/2005 Chang
2005/0043145 A1 2/2005 Anderson et al.
2005/0043146 A1 2/2005 Lo et al.
2005/0043155 A1 2/2005 Yannitte
2005/0049117 A1 3/2005 Rodgers
2005/0049121 A1 3/2005 Dalebout
2005/0054492 A1 3/2005 Neff
2005/0064994 A1 3/2005 Matsumoto
2005/0090770 A1 4/2005 Chen
2005/0096187 A1 5/2005 Hsu
2005/0096189 A1 5/2005 Chen
2005/0107220 A1 5/2005 Wang
2005/0107226 A1 5/2005 Monda
2005/0113158 A1 5/2005 Sterchi et al.
2005/0129903 A1 6/2005 Carr
2005/0131319 A1 6/2005 Der Meer

(56) References Cited

U.S. PATENT DOCUMENTS

2005/0132838 A1 6/2005 Lin
2005/0143226 A1 6/2005 Heidecke
2005/0143228 A1 6/2005 Lee
2005/0148398 A1 7/2005 Lochtefeld et al.
2005/0148439 A1 7/2005 Wu
2005/0148440 A1 7/2005 Denton
2005/0148442 A1 7/2005 Watterson
2005/0159273 A1 7/2005 Chen
2005/0164838 A1 7/2005 Watterson
2005/0164839 A1* 7/2005 Watterson ..... A63B 22/02 482/54
2005/0170935 A1 8/2005 Manser
2005/0170936 A1 8/2005 Quinn
2005/0172311 A1 8/2005 Hjelt et al.
2005/0178210 A1 8/2005 Lanham
2005/0181347 A1 8/2005 Barnes et al.
2005/0181911 A1 8/2005 Porth
2005/0192162 A1 9/2005 Pan
2005/0196737 A1 9/2005 Mann
2005/0202934 A1 9/2005 Olrik et al.
2005/0209050 A1 9/2005 Bartels
2005/0209051 A1 9/2005 Santomassimo et al.
2005/0209052 A1 9/2005 Ashby et al.
2005/0209062 A1 9/2005 Anderson et al.
2005/0215397 A1 9/2005 Watterson
2005/0233861 A1 10/2005 Hickman
2005/0233871 A1 10/2005 Anders
2005/0239600 A1 10/2005 Liang
2005/0239607 A1 10/2005 Chang
2005/0245370 A1 11/2005 Boland
2005/0250622 A1 11/2005 Chang
2005/0266961 A1 12/2005 Shum et al.
2005/0272562 A1 12/2005 Alessandri et al.
2005/0272577 A1 12/2005 Olson
2005/0277520 A1 12/2005 Van Waes
2005/0281963 A1 12/2005 Cook
2005/0283911 A1 12/2005 Roussy
2005/0288155 A1 12/2005 Yang
2006/0003869 A1 1/2006 Huang et al.
2006/0004265 A1 1/2006 Pulkkinen et al.
2006/0019804 A1 1/2006 Young
2006/0035757 A1 2/2006 Flick et al.
2006/0035758 A1 2/2006 Rogozinski
2006/0040797 A1 2/2006 Chang
2006/0047447 A1 3/2006 Brady et al.
2006/0053586 A1 3/2006 Chase
2006/0053587 A1 3/2006 Chase
2006/0058158 A1 3/2006 McAvoy
2006/0058162 A1 3/2006 Vieno et al.
2006/0063644 A1 3/2006 Yang
2006/0075544 A1 4/2006 Kriesel
2006/0079800 A1 4/2006 Martikka et al.
2006/0100069 A1 5/2006 Dibble et al.
2006/0100546 A1 5/2006 Silk
2006/0122038 A1 6/2006 Chou Lin
2006/0122044 A1 6/2006 Ho
2006/0123814 A1 6/2006 Choi et al.
2006/0128534 A1 6/2006 Roque
2006/0135274 A1 6/2006 Henry
2006/0135322 A1 6/2006 Rocker
2006/0148622 A1 7/2006 Chen
2006/0151303 A1 7/2006 Motoda
2006/0160665 A1 7/2006 Tai
2006/0160666 A1 7/2006 Wang
2006/0166791 A1 7/2006 Liao
2006/0166799 A1 7/2006 Boland et al.
2006/0189439 A1 8/2006 Baudhuin
2006/0189440 A1 8/2006 Gravagne
2006/0189462 A1 8/2006 Pearson et al.
2006/0194679 A1 8/2006 Hatcher
2006/0199706 A1 9/2006 Wehrell
2006/0205568 A1 9/2006 Huang
2006/0217236 A1 9/2006 Watterson
2006/0217245 A1 9/2006 Golesh et al.
2006/0223680 A1 10/2006 Chang
2006/0229163 A1 10/2006 Waters
2006/0229170 A1 10/2006 Ozawa et al.
2006/0232147 A1 10/2006 Cheng
2006/0234832 A1 10/2006 Toyama et al.
2006/0240947 A1 10/2006 Qu
2006/0240951 A1 10/2006 Wang
2006/0240959 A1 10/2006 Huang
2006/0244187 A1 11/2006 Downey
2006/0247109 A1 11/2006 Powell
2006/0248965 A1 11/2006 Wyatt
2006/0252602 A1 11/2006 Brown
2006/0252604 A1 11/2006 Moon
2006/0252608 A1 11/2006 Kang et al.
2006/0258513 A1 11/2006 Routley
2006/0258515 A1 11/2006 Kang et al.
2006/0264306 A1 11/2006 Tischler
2006/0270522 A1 11/2006 Yonehana et al.
2006/0276306 A1 12/2006 Pan et al.
2006/0279294 A1 12/2006 Cehelnik
2006/0287089 A1 12/2006 Addington et al.
2006/0287147 A1 12/2006 Kriesel
2006/0287163 A1 12/2006 Wang
2006/0288846 A1 12/2006 Logan
2007/0004561 A1 1/2007 Yoo
2007/0004562 A1 1/2007 Pan et al.
2007/0004569 A1 1/2007 Cao
2007/0006489 A1 1/2007 Case et al.
2007/0010383 A1 1/2007 Pertegaz-Esteban
2007/0015635 A1 1/2007 Donner
2007/0015636 A1 1/2007 Molter
2007/0026975 A1 2/2007 Marty et al.
2007/0027002 A1 2/2007 Clark et al.
2007/0037667 A1 2/2007 Gordon
2007/0038137 A1 2/2007 Arand et al.
2007/0042868 A1 2/2007 Fisher
2007/0049462 A1 3/2007 Asukai et al.
2007/0049464 A1 3/2007 Chou
2007/0049465 A1 3/2007 Wu
2007/0049466 A1 3/2007 Hubbard
2007/0049470 A1 3/2007 Pyles et al.
2007/0054790 A1 3/2007 Dodge et al.
2007/0060449 A1 3/2007 Lo
2007/0060450 A1 3/2007 Lo
2007/0060451 A1 3/2007 Lucas
2007/0066448 A1 3/2007 Pan et al.
2007/0072748 A1 3/2007 Lee
2007/0072752 A1 3/2007 Koch
2007/0079691 A1 4/2007 Turner
2007/0087908 A1 4/2007 Pan et al.
2007/0111858 A1 5/2007 Dugan
2007/0111866 A1 5/2007 McVay et al.
2007/0117683 A1 5/2007 Ercanbrack et al.
2007/0123389 A1 5/2007 Martin
2007/0123390 A1 5/2007 Mathis
2007/0123395 A1 5/2007 Ellis
2007/0123396 A1 5/2007 Ellis
2007/0131409 A1 6/2007 Asahi
2007/0135264 A1 6/2007 Rosenberg
2007/0137331 A1 6/2007 Kachouh
2007/0142177 A1 6/2007 Simms et al.
2007/0142179 A1 6/2007 Terao et al.
2007/0142183 A1 6/2007 Chang
2007/0149363 A1 6/2007 Wang
2007/0151489 A1 7/2007 Byrne
2007/0155277 A1 7/2007 Amitai et al.
2007/0155495 A1 7/2007 Goo
2007/0161468 A1 7/2007 Yanagisawa et al.
2007/0167292 A1 7/2007 Kuo
2007/0179023 A1 8/2007 Dyer
2007/0184953 A1 8/2007 Luberski et al.
2007/0190508 A1 8/2007 Dalton
2007/0191141 A1 8/2007 Weber
2007/0191190 A1 8/2007 Kuo
2007/0197274 A1 8/2007 Dugan
2007/0197353 A1 8/2007 Hundley
2007/0197920 A1 8/2007 Adams
2007/0201727 A1 8/2007 Birrell et al.
2007/0204430 A1 9/2007 Chase
2007/0214630 A1 9/2007 Kim

(56) References Cited

U.S. PATENT DOCUMENTS

2007/0219066 A1 9/2007 Wang
2007/0225119 A1 9/2007 Schenk
2007/0225120 A1 9/2007 Schenk
2007/0225126 A1 9/2007 Yoo
2007/0225127 A1 9/2007 Pan et al.
2007/0225622 A1 9/2007 Huang et al.
2007/0232455 A1 10/2007 Hanoun
2007/0232463 A1 10/2007 Wu
2007/0245612 A1 10/2007 Tresenfeld
2007/0247320 A1 10/2007 Morahan
2007/0249467 A1 10/2007 Hong et al.
2007/0270294 A1 11/2007 Sheets
2007/0270667 A1 11/2007 Coppi et al.
2007/0270726 A1 11/2007 Chou
2007/0281828 A1 12/2007 Rice
2007/0281831 A1 12/2007 Wang
2007/0284495 A1 12/2007 Charles
2007/0296313 A1 12/2007 Wang
2007/0298935 A1 12/2007 Badarneh
2007/0298937 A1 12/2007 Shah
2008/0001772 A1 1/2008 Saito
2008/0001866 A1 1/2008 Martin
2008/0004162 A1 1/2008 Chen
2008/0018211 A1 1/2008 Dye
2008/0020898 A1 1/2008 Pyles et al.
2008/0020902 A1 1/2008 Arnold
2008/0020907 A1 1/2008 Lin
2008/0026658 A1 1/2008 Kriesel
2008/0026838 A1 1/2008 Dunstan et al.
2008/0032864 A1 2/2008 Hakki
2008/0032870 A1 2/2008 Wu
2008/0032871 A1 2/2008 Yeh
2008/0039301 A1 2/2008 Halbridge
2008/0046246 A1 2/2008 Hakki
2008/0051256 A1 2/2008 Ashby et al.
2008/0057889 A1 3/2008 Jan
2008/0058169 A1 3/2008 Fox
2008/0058170 A1 3/2008 Giannascoli et al.
2008/0067302 A1 3/2008 Olivera
2008/0070756 A1 3/2008 Chu
2008/0076637 A1 3/2008 Gilley et al.
2008/0076972 A1 3/2008 Dorogusker et al.
2008/0077619 A1 3/2008 Gilley et al.
2008/0096745 A1 4/2008 Perry
2008/0103024 A1 5/2008 Habing
2008/0103034 A1 5/2008 Mihara et al.
2008/0108917 A1 5/2008 Joutras et al.
2008/0119333 A1 5/2008 Bowser
2008/0139370 A1 6/2008 Charnitski
2008/0153670 A1 6/2008 Mckirdy
2008/0153682 A1 6/2008 Chen et al.
2008/0155077 A1 6/2008 James
2008/0161170 A1 7/2008 Lumpee
2008/0161653 A1 7/2008 Lin et al.
2008/0171640 A1 7/2008 Chang
2008/0171922 A1 7/2008 Teller
2008/0176717 A1 7/2008 Wang
2008/0176718 A1 7/2008 Wang
2008/0182724 A1 7/2008 Guthrie
2008/0187689 A1 8/2008 Domo
2008/0188362 A1 8/2008 Chen
2008/0190745 A1 8/2008 Taniguchi et al.
2008/0191864 A1 8/2008 Wolfson
2008/0200287 A1 8/2008 Marty et al.
2008/0200310 A1 8/2008 Tagliabue
2008/0207407 A1 8/2008 Yeh
2008/0214358 A1 9/2008 Ogg et al.
2008/0214971 A1 9/2008 Talish
2008/0216717 A1 9/2008 Jones
2008/0228110 A1 9/2008 Berme
2008/0229875 A1 9/2008 Ray
2008/0234110 A1 9/2008 Webber et al.
2008/0234111 A1 9/2008 Packham
2008/0242511 A1 10/2008 Munoz et al.
2008/0244870 A1 10/2008 Chase
2008/0245944 A1 10/2008 Chase
2008/0248926 A1 10/2008 Cole et al.
2008/0248935 A1 10/2008 Solow
2008/0250729 A1 10/2008 Kriesel
2008/0255794 A1 10/2008 Levine
2008/0279896 A1 11/2008 Heinen et al.
2008/0280732 A1 11/2008 Jones
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0300110 A1 12/2008 Smith et al.
2008/0300114 A1 12/2008 Dalebout
2008/0300115 A1 12/2008 Erlandson
2008/0300914 A1 12/2008 Karkanias et al.
2008/0312040 A1 12/2008 Ochi
2008/0312047 A1 12/2008 Feng
2008/0318737 A1 12/2008 Chu
2009/0001831 A1 1/2009 Cho et al.
2009/0011907 A1 1/2009 Radow
2009/0023553 A1 1/2009 Shim
2009/0027925 A1 1/2009 Kanouda et al.
2009/0029831 A1 1/2009 Weier
2009/0036276 A1 2/2009 Loach
2009/0042696 A1 2/2009 Wang
2009/0042698 A1 2/2009 Wang
2009/0048073 A1 2/2009 Roimicher
2009/0048079 A1 2/2009 Nalley
2009/0048493 A1 2/2009 James et al.
2009/0053682 A1 2/2009 Stern
2009/0054214 A1 2/2009 Kadar
2009/0054751 A1 2/2009 Babashan et al.
2009/0069159 A1 3/2009 Wang
2009/0069722 A1 3/2009 Flaction et al.
2009/0075781 A1 3/2009 Schwarzberg et al.
2009/0075784 A1 3/2009 Hoggan
2009/0080808 A1 3/2009 Hagen
2009/0093347 A1 4/2009 Wang
2009/0100718 A1 4/2009 Gerber
2009/0105047 A1 4/2009 Guidi et al.
2009/0105052 A1 4/2009 Dalebout et al.
2009/0105548 A1 4/2009 Bart
2009/0111664 A1 4/2009 Kau
2009/0111665 A1 4/2009 Wang
2009/0111666 A1 4/2009 Wang
2009/0111670 A1 4/2009 Williams
2009/0118098 A1 5/2009 Yeh
2009/0119032 A1 5/2009 Meyer
2009/0120208 A1 5/2009 Meyer
2009/0120210 A1 5/2009 Phillips et al.
2009/0124463 A1 5/2009 Lin
2009/0124464 A1 5/2009 Kastelic
2009/0124465 A1 5/2009 Wang
2009/0124466 A1 5/2009 Zhang
2009/0128516 A1 5/2009 Rimon et al.
2009/0131225 A1 5/2009 Burdea
2009/0144639 A1 6/2009 Nims et al.
2009/0156363 A1 6/2009 Guidi et al.
2009/0156364 A1 6/2009 Simeoni
2009/0158871 A1 6/2009 Chuo
2009/0163326 A1 6/2009 Wang
2009/0163327 A1 6/2009 Huang et al.
2009/0170667 A1 7/2009 Irving et al.
2009/0170672 A1 7/2009 Mcmullen
2009/0176625 A1 7/2009 Giannelli et al.
2009/0176628 A1 7/2009 Radding et al.
2009/0180646 A1 7/2009 Vulfson et al.
2009/0181829 A1 7/2009 Wu
2009/0181830 A1 7/2009 Wu
2009/0181831 A1 7/2009 Kuo
2009/0181833 A1 7/2009 Cassidy
2009/0197740 A1 8/2009 Julskjaer et al.
2009/0209393 A1 8/2009 Crater et al.
2009/0221405 A1 9/2009 Wang
2009/0221407 A1 9/2009 Hauk
2009/0227424 A1 9/2009 Hirata et al.
2009/0227432 A1 9/2009 Pacheco
2009/0232420 A1 9/2009 Eisenberg et al.
2009/0240858 A1 9/2009 Takebayashi

(56) References Cited

U.S. PATENT DOCUMENTS

2009/0246746 A1 10/2009 Roerdink et al.
2009/0253554 A1 10/2009 Mcintosh
2009/0258710 A1 10/2009 Quatrochi et al.
2009/0258763 A1 10/2009 Richter
2009/0269728 A1 10/2009 Verstegen et al.
2009/0286653 A1 11/2009 Wiber
2009/0293319 A1 12/2009 Avni
2009/0312158 A1 12/2009 Trevino et al.
2010/0015585 A1 1/2010 Baker
2010/0016127 A1 1/2010 Farnsworth et al.
2010/0022354 A1 1/2010 Fisher
2010/0024590 A1 2/2010 O'neill
2010/0032533 A1 2/2010 Chen et al.
2010/0034665 A1 2/2010 Zhong et al.
2010/0035726 A1 2/2010 Fisher et al.
2010/0041516 A1 2/2010 Kodama
2010/0048358 A1 2/2010 Tchao et al.
2010/0062904 A1 3/2010 Crawford et al.
2010/0062914 A1 3/2010 Splane
2010/0063426 A1 3/2010 Planke
2010/0064255 A1 3/2010 Rottler et al.
2010/0079291 A1 4/2010 Kroll et al.
2010/0081548 A1 4/2010 Labedz
2010/0087298 A1 4/2010 Zaccherini
2010/0099541 A1 4/2010 Patel
2010/0105527 A1 4/2010 Johnson
2010/0113223 A1 5/2010 Chiles et al.
2010/0125026 A1 5/2010 Zavadsky et al.
2010/0130337 A1 5/2010 Stewart
2010/0137105 A1 6/2010 McLaughlin
2010/0144501 A1 6/2010 Berhanu
2010/0156625 A1 6/2010 Ruha
2010/0167883 A1 7/2010 Grind
2010/0173276 A1 7/2010 Vasin
2010/0173755 A1 7/2010 P Erez De Lazarraga
2010/0175634 A1 7/2010 Chang et al.
2010/0184568 A1 7/2010 Schippers
2010/0190615 A1 7/2010 Baker et al.
2010/0192715 A1 8/2010 Vauchel et al.
2010/0197462 A1 8/2010 Piane, Jr.
2010/0197465 A1 8/2010 Stevenson
2010/0197469 A1 8/2010 Wilkins
2010/0210418 A1 8/2010 Park
2010/0216599 A1 8/2010 Watterson
2010/0216600 A1 8/2010 Noffsinger
2010/0216607 A1 8/2010 Mueller
2010/0222179 A1 9/2010 Temple et al.
2010/0222182 A1 9/2010 Park
2010/0227740 A1 9/2010 Liu
2010/0235667 A1 9/2010 Mucignat et al.
2010/0240458 A1 9/2010 Gaiba et al.
2010/0248899 A1 9/2010 Bedell et al.
2010/0255959 A1 10/2010 Dalebout et al.
2010/0267524 A1 10/2010 Stewart et al.
2010/0279822 A1 11/2010 Ford
2010/0285933 A1 11/2010 Nalley
2010/0289466 A1 11/2010 Telefus
2010/0289772 A1 11/2010 Miller
2010/0292050 A1 11/2010 DiBenedetto et al.
2010/0304931 A1 12/2010 Stumpf
2010/0304932 A1 12/2010 Kolman et al.
2010/0311552 A1 12/2010 Sumners
2010/0320956 A1 12/2010 Lumsden et al.
2011/0003664 A1 1/2011 Richard
2011/0021319 A1 1/2011 Nissila et al.
2011/0028282 A1 2/2011 Sbragia
2011/0034300 A1 2/2011 Hall
2011/0054359 A1 3/2011 Sazonov et al.
2011/0056328 A1 3/2011 Ko
2011/0061840 A1 3/2011 Goldmann
2011/0065371 A1 3/2011 Leff
2011/0065373 A1 3/2011 Goldmann
2011/0067361 A1 3/2011 Sloan
2011/0073743 A1 3/2011 Shamie
2011/0075835 A1 3/2011 Hill
2011/0077055 A1 3/2011 Pakula et al.
2011/0082013 A1 4/2011 Bastian
2011/0086707 A1 4/2011 Loveland
2011/0087137 A1 4/2011 Hanoun
2011/0087445 A1 4/2011 Sobolewski
2011/0087446 A1 4/2011 Redmond
2011/0093100 A1 4/2011 Ramsay
2011/0098157 A1 4/2011 Whalen et al.
2011/0098615 A1 4/2011 Whalen et al.
2011/0109283 A1 5/2011 Kapels et al.
2011/0112771 A1 5/2011 French
2011/0118089 A1 5/2011 Ellis
2011/0124466 A1 5/2011 Nishimura
2011/0124476 A1 5/2011 Holley
2011/0131005 A1 6/2011 Ueshima et al.
2011/0136627 A1 6/2011 Williams
2011/0143769 A1 6/2011 Jones et al.
2011/0143898 A1 6/2011 Trees
2011/0152037 A1 6/2011 Tsou
2011/0152038 A1 6/2011 Freitag
2011/0152039 A1 6/2011 Hendrickson et al.
2011/0152635 A1 6/2011 Morris et al.
2011/0165995 A1 7/2011 Paulus
2011/0172060 A1 7/2011 Morales et al.
2011/0175744 A1 7/2011 Englert et al.
2011/0181420 A1 7/2011 Mack et al.
2011/0188269 A1 8/2011 Hosotani
2011/0197157 A1 8/2011 Hoffman et al.
2011/0199799 A1 8/2011 Hui et al.
2011/0201481 A1 8/2011 Lo
2011/0202236 A1 8/2011 Galasso et al.
2011/0205164 A1 8/2011 Hansen et al.
2011/0221672 A1 9/2011 Osterhout et al.
2011/0247530 A1 10/2011 Coffman
2011/0252597 A1 10/2011 Burris et al.
2011/0257797 A1 10/2011 Burris et al.
2011/0269517 A1 11/2011 Englert et al.
2011/0269604 A1 11/2011 Tseng
2011/0275482 A1 11/2011 Brodess et al.
2011/0275489 A1 11/2011 Apau
2011/0275499 A1 11/2011 Eschenbach
2011/0281691 A1 11/2011 Ellis
2011/0283188 A1 11/2011 Farrenkopf et al.
2011/0283231 A1 11/2011 Richstein et al.
2011/0308919 A1 12/2011 Hahn
2011/0312473 A1 12/2011 Chu et al.
2011/0319229 A1 12/2011 Corbalis et al.
2012/0004075 A1 1/2012 Kissel et al.
2012/0004080 A1 1/2012 Webb
2012/0010053 A1 1/2012 Bayerlein et al.
2012/0015778 A1 1/2012 Lee et al.
2012/0015779 A1 1/2012 Powch et al.
2012/0015784 A1 1/2012 Reed
2012/0020135 A1 1/2012 McCune
2012/0021873 A1 1/2012 Brunner
2012/0021875 A1 1/2012 Karl
2012/0032896 A1 2/2012 Vesely
2012/0071301 A1 3/2012 Kaylor et al.
2012/0088633 A1 4/2012 Crafton
2012/0088634 A1 4/2012 Heidecke
2012/0088640 A1 4/2012 Wissink
2012/0116684 A1 5/2012 Ingrassia et al.
2012/0132877 A1 5/2012 Wang
2012/0133192 A1 5/2012 Simpson
2012/0165162 A1 6/2012 Lu
2012/0169603 A1 7/2012 Peterson et al.
2012/0174833 A1 7/2012 Early
2012/0178590 A1 7/2012 Lu
2012/0187012 A1 7/2012 TeVault et al.
2012/0190502 A1 7/2012 Paulus et al.
2012/0212505 A1 8/2012 Burroughs et al.
2012/0218184 A1 8/2012 Wissmar
2012/0230504 A1 9/2012 Kuroda
2012/0242774 A1 9/2012 Numano et al.
2012/0248263 A1 10/2012 Grotenhuis
2012/0252580 A1 10/2012 Dugan
2012/0253234 A1 10/2012 Yang et al.
2012/0253489 A1 10/2012 Dugan
2012/0258433 A1 10/2012 Hope et al.

(56) References Cited

U.S. PATENT DOCUMENTS

2012/0263892 A1 10/2012 Rodgers
2012/0270705 A1 10/2012 Lo
2012/0271143 A1 10/2012 Aragones et al.
2012/0277040 A1 11/2012 Vincent et al.
2012/0277891 A1 11/2012 Aragones et al.
2012/0293141 A1 11/2012 Zhang et al.
2012/0296455 A1 11/2012 Ohnemus et al.
2012/0298017 A1 11/2012 Chen
2012/0300515 A1 11/2012 Carletti et al.
2012/0319604 A1 12/2012 Walters
2012/0326873 A1 12/2012 Utter, II
2013/0002533 A1 1/2013 Burroughs et al.
2013/0004010 A1 1/2013 Royer
2013/0009993 A1 1/2013 Horseman
2013/0018494 A1 1/2013 Amini
2013/0034671 A1 2/2013 George
2013/0035612 A1 2/2013 Mason et al.
2013/0040783 A1 2/2013 Duda et al.
2013/0041590 A1 2/2013 Burich et al.
2013/0041617 A1 2/2013 Pease et al.
2013/0044521 A1 2/2013 Zhao et al.
2013/0050973 A1 2/2013 Rohrbach
2013/0053222 A1 2/2013 Lo
2013/0053990 A1 2/2013 Ackland
2013/0092647 A1 4/2013 Chen
2013/0095960 A9 4/2013 Marty et al.
2013/0095978 A1 4/2013 Sauter
2013/0130868 A1 5/2013 Hou
2013/0130869 A1 5/2013 Hou
2013/0139736 A1 6/2013 Flaherty
2013/0141235 A1 6/2013 Utter, II
2013/0147411 A1 6/2013 Pang et al.
2013/0150214 A1 6/2013 Wu
2013/0154441 A1 6/2013 Redmond
2013/0165297 A1 6/2013 Daly
2013/0172152 A1 7/2013 Watterson
2013/0182781 A1 7/2013 Matsutani
2013/0185003 A1 7/2013 Carbeck et al.
2013/0190136 A1 7/2013 Watterson
2013/0190143 A1 7/2013 Greenhill et al.
2013/0190657 A1 7/2013 Flaction et al.
2013/0196821 A1 8/2013 Watterson et al.
2013/0196826 A1 8/2013 Colledge
2013/0196827 A1 8/2013 Chang
2013/0211858 A1 8/2013 Ohnemus et al.
2013/0228063 A1 9/2013 Turner
2013/0228422 A1 9/2013 Mathieu
2013/0231219 A1 9/2013 Huang
2013/0237383 A1 9/2013 Chen
2013/0245966 A1 9/2013 Burroughs et al.
2013/0263418 A1 10/2013 Johnson, Jr.
2013/0267386 A1 10/2013 Her
2013/0274040 A1 10/2013 Coza et al.
2013/0274069 A1 10/2013 Watterson et al.
2013/0274071 A1 10/2013 Wang
2013/0280682 A1 10/2013 Levine et al.
2013/0324368 A1 12/2013 Aragones et al.
2013/0325394 A1 12/2013 Yuen et al.
2013/0338802 A1 12/2013 Winsper et al.
2013/0346043 A1 12/2013 Mewes et al.
2014/0011645 A1 1/2014 Johnson et al.
2014/0026788 A1 1/2014 Kallio, III et al.
2014/0031703 A1 1/2014 Rayner et al.
2014/0039840 A1 2/2014 Yuen et al.
2014/0052280 A1 2/2014 Yuen et al.
2014/0056461 A1 2/2014 Afshar
2014/0073488 A1 3/2014 Wu
2014/0080678 A1 3/2014 Wu
2014/0085077 A1 3/2014 Luna et al.
2014/0100464 A1 4/2014 Kaleal et al.
2014/0102340 A1 4/2014 Kooistra
2014/0121066 A1 5/2014 Huang et al.
2014/0139450 A1 5/2014 Levesque et al.
2014/0156228 A1 6/2014 Molettiere et al.
2014/0171266 A1 6/2014 Hawkins, III et al.
2014/0187383 A1 7/2014 Martin
2014/0195103 A1 7/2014 Nassef
2014/0221160 A1 8/2014 Hardy et al.
2014/0222173 A1 8/2014 Giedwoyn et al.
2014/0265690 A1 9/2014 Henderson
2014/0270375 A1 9/2014 Canavan et al.
2014/0274564 A1 9/2014 Greenbaum
2014/0274579 A1 9/2014 Olson
2014/0358473 A1 12/2014 Goel et al.
2014/0360413 A1 12/2014 Schenk
2015/0001048 A1 1/2015 Koppes et al.
2015/0003621 A1 1/2015 Trammell
2015/0004579 A1 1/2015 Shelton
2015/0016623 A1 1/2015 Trammell
2015/0044648 A1 2/2015 White et al.
2015/0048807 A1 2/2015 Fan et al.
2015/0065273 A1* 3/2015 Lake ..... A63B 69/34
473/422
2015/0065301 A1 3/2015 Oteman
2015/0105220 A1 4/2015 Hong
2015/0192929 A1 7/2015 Rihn et al.
2015/0199494 A1 7/2015 Koduri et al.
2015/0201722 A1 7/2015 Brouard
2015/0202487 A1 7/2015 Wu
2015/0209610 A1 7/2015 Dalebout et al.
2015/0209617 A1 7/2015 Hsiao
2015/0246751 A1 9/2015 Spivack et al.
2015/0250304 A1 9/2015 Dalebout
2015/0251047 A1* 9/2015 Maaniitty ..... A47B 21/02
482/54
2015/0251048 A1 9/2015 Dalebout
2015/0251055 A1 9/2015 Ashby
2015/0253210 A1 9/2015 Ashby et al.
2015/0265903 A1 9/2015 Kolen et al.
2015/0295397 A1 10/2015 Lin et al.
2015/0314184 A1 11/2015 Moya Saez
2015/0346994 A1 12/2015 Chanyontpatanakul
2015/0352396 A1 12/2015 Dalebout
2015/0352401 A1 12/2015 Johnson
2015/0352402 A1 12/2015 Arnold et al.
2015/0367158 A1 12/2015 Pretz et al.
2015/0367176 A1 12/2015 Bejestan et al.
2016/0008650 A1 1/2016 Jue et al.
2016/0016035 A1 1/2016 Hao
2016/0027325 A1 1/2016 Malhotra
2016/0038785 A1 2/2016 Netter
2016/0047446 A1 2/2016 Hung
2016/0066818 A1 3/2016 Cowley et al.
2016/0096064 A1 4/2016 Gatti
2016/0121161 A1 5/2016 Mountain
2016/0175643 A1 6/2016 Kueker et al.
2016/0193518 A1* 7/2016 Baxter ..... A63B 69/0071
473/450
2016/0211841 A1 7/2016 Harrison
2016/0219968 A1 8/2016 Martin
2016/0263426 A1 9/2016 Mueller et al.
2016/0303421 A1 10/2016 Tyger et al.
2016/0317861 A1 11/2016 Dalebout
2016/0367851 A1 12/2016 Astilean et al.
2017/0056726 A1 3/2017 Dalebout et al.
2017/0068782 A1 3/2017 Pillai et al.
2017/0113093 A1 4/2017 Bellavista et al.
2017/0120102 A1 5/2017 Chen
2017/0128784 A1 5/2017 Molins et al.
2017/0136280 A1 5/2017 Lee
2017/0136288 A1 5/2017 Huang
2017/0136289 A1 5/2017 Frank
2017/0136291 A1 5/2017 Huang
2017/0136339 A1 5/2017 Habiche
2017/0165523 A1 6/2017 Chou
2017/0189745 A1 7/2017 Hamilton et al.
2017/0216660 A1 8/2017 Lernihan
2017/0266483 A1 9/2017 Dalebout et al.
2017/0266532 A1 9/2017 Watterson
2017/0266533 A1 9/2017 Dalebout
2017/0266534 A1 9/2017 Watterson
2017/0266535 A1 9/2017 Watterson
2017/0274242 A1 9/2017 Corbalis
2017/0326411 A1 11/2017 Watterson

(56) References Cited

U.S. PATENT DOCUMENTS

| | | | | |
|---|---|---|---|---|
| 2017/0340917 | A1 | 11/2017 | Chang | |
| 2017/0368442 | A1 | 12/2017 | Baudhuin | |
| 2018/0001135 | A1 | 1/2018 | Powell | |
| 2018/0036585 | A1 | 2/2018 | Powell | |
| 2018/0056111 | A1 | 3/2018 | Chiang et al. | |
| 2018/0092603 | A1 | 4/2018 | Duan et al. | |
| 2018/0099179 | A1* | 4/2018 | Chatterton | A63B 22/0242 |
| 2018/0099180 | A1 | 4/2018 | Wilkinson | |
| 2018/0099181 | A1 | 4/2018 | Powell et al. | |
| 2018/0104533 | A1 | 4/2018 | Powell et al. | |
| 2018/0111018 | A1 | 4/2018 | Lee | |
| 2018/0117385 | A1 | 5/2018 | Watterson et al. | |
| 2018/0117388 | A1 | 5/2018 | Porter | |
| 2018/0117419 | A1 | 5/2018 | Jackson | |
| 2018/0147440 | A1 | 5/2018 | Lin | |
| 2018/0154205 | A1 | 6/2018 | Watterson | |
| 2018/0154208 | A1 | 6/2018 | Powell et al. | |

FOREIGN PATENT DOCUMENTS

| | | |
|---|---|---|
| KR | 1019900006049 | 8/1990 |
| KR | 101571361 | 11/2015 |

OTHER PUBLICATIONS

English Translation of Office Action and Search Report Issued in Taiwan Patent Application No. 106134684 dated May 15, 2018.

* cited by examiner

DISTANCE SENSOR FOR CONSOLE POSITIONING

RELATED APPLICATIONS

This application claims priority to U.S. Patent Application Ser. No. 62/415,898 titled "Distance Sensor for Console Positioning" and filed on 1 Nov. 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running Many choose to perform aerobic exercises indoors, such as in a gym or their home. Often, a user will use an aerobic exercise machine to perform an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include ellipticals, rowing machines, stepper machines, and stationary bikes, to name a few.

One type of treadmill is disclosed in U.S. Patent Publication No. 2012/0220427 issued to Darren C. Ashby, et al. In this reference, an exercise system includes one or more exercise devices that communicate via a network with a communication system. The communication system stores and/or generates exercise programming for use on the exercise device. The exercise programming is able to control one or more operating parameters of the exercise device to simulate terrain found at a remote, real world location. The exercise programming can include images/videos of the remote, real world location. The control signals and the images/videos can be synchronized so that a user of the exercise device is able to experience, via the changing operating parameters, the topographical characteristics of the remote, real world location as well as see images of the location. Another type of treadmill is described in U.S. Patent Publication No. 2009/0209393 issued to Bradley A. Crater, et al., which references are incorporated herein by reference, for all that they disclose.

SUMMARY

In one embodiment, an exercise device includes a frame, a console movably attached to the frame, a sensor associated with the exercise device, memory, and a processor. The memory includes programmed instructions that, when executed, cause the processor to measure a distance between console and a portion of the frame with the sensor and adjust a position of the console based on the measurement.

The position may be an angular position.

The position may be height position.

The sensor may be connected to the console.

The sensor may be incorporated into the deck.

The sensor may be a time-of-flight sensor.

The sensor may be an optical sensor.

The sensor may be a magnetic sensor.

The exercise device may include an exercise deck where the portion of the frame is incorporated into the exercise deck.

The exercise device may include an incline mechanism that adjusts an orientation of the exercise deck. The programmed instructions further, when executed, may cause the processor to measure the distance between the console and the portion of the frame incorporated into the exercise deck in response to the incline mechanism adjusting the orientation.

The programmed instructions, when executed, may cause the memory to store a user profile.

The programmed instructions, when executed, may cause the processor to change the console height in response to information in the user profile.

The exercise machine may be a treadmill.

In one embodiment, a treadmill includes an upright structure, an exercise deck independently movable of the upright structure, a console movably attached to the upright structure, a sensor associated with the treadmill, an incline mechanism that adjusts an orientation of the exercise deck, memory, and a processor. The memory may include programmed instructions that, when executed, cause the processor to measure a distance between console and a deck with the sensor in response to the incline mechanism adjusting the orientation and adjust a position of the console based on the measurement.

The programmed instructions, when executed, may cause the memory to store a user profile.

The programmed instructions, when executed, may cause the processor to change the console height in response to information in the user profile.

The sensor may be connected to the console.

The sensor may be incorporated into or connected to the deck.

The sensor may be a time-of-flight sensor.

In one embodiment, a treadmill includes an upright structure, an exercise deck independently movable of the upright structure, a console movably attached to the upright structure, a time-of-flight sensor incorporated into the console, an incline mechanism that adjusts an orientation of the exercise deck, memory, and a processor. The memory may include programmed instructions that, when executed, cause the processor to measure a distance between console and a deck with the time-of-flight sensor in response to the incline mechanism adjusting the orientation, store a user profile, and adjust a position of the console based on the measurement and a parameter in the user profile.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
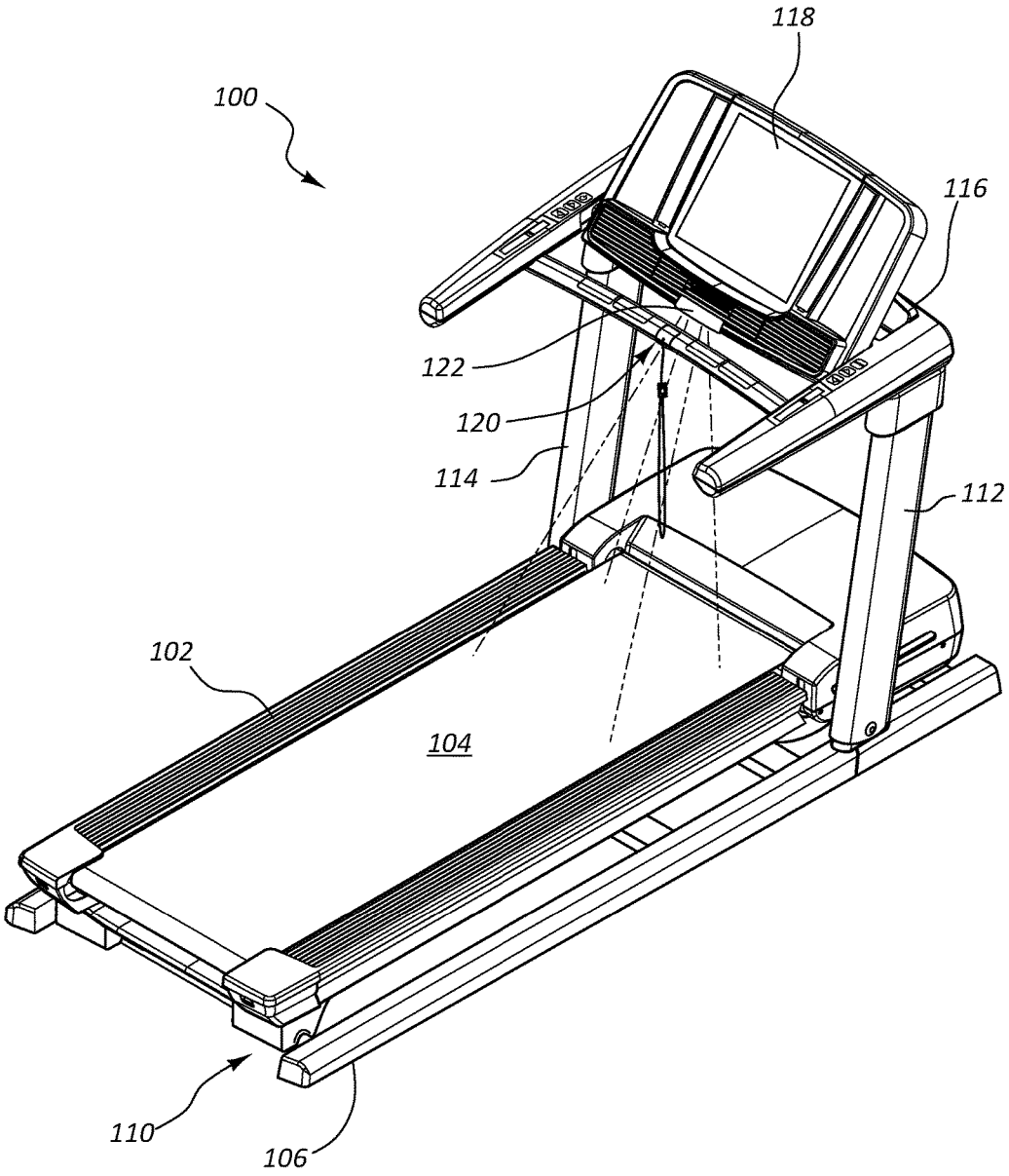
FIG. 1 illustrates a perspective view of an example of a treadmill in a neutral position in accordance with the present disclosure.

FIG. 1 depicts an example of a treadmill 100 having a deck 102 with a first pulley disposed in a front portion of the deck 102 and a second pulley incorporated into a rear portion of the deck 102. A tread belt 104 surrounds the first pulley and the second pulley. A motor is in mechanical communication with either the first pulley or the second pulley.

The rear portion of the deck 102 is attached to a base member 106 of the treadmill's frame. A pivot connection 110 between the rear portion of the deck 102 and the base member 106 allows the front portion of the deck 102 to incline upwards or decline downwards. When the deck 102 inclines or declines, the base member 106 remains stationary.

A first side post 112 is attached to a first side of the base member 106, and a second side post 114 is attached to a second side of the base member 106. In the example depicted in FIG. 1, the first side post 112 and the second side post 114 also remain stationary as the deck 102 inclines and/or declines. The first side post 112 and the second side post 114 collectively support a console 116. The console 116 includes a display 118 and an input mechanism 120 for controlling the deck's incline angle.

A sensor 122 is connected to or otherwise incorporated into the console 116. In some examples, the sensor 122 is a distance sensor that is oriented to determine the distance between the deck 102 and the console 116. As the deck 102 moves relative to the console 116, the sensor 122 can determine the movement changes. In response to the movement changes, the sensor 122 can send a message to actuators to cause the console to move so that the console 116 and the deck 102 can maintain a predetermined distance from one another.

Figure 2:
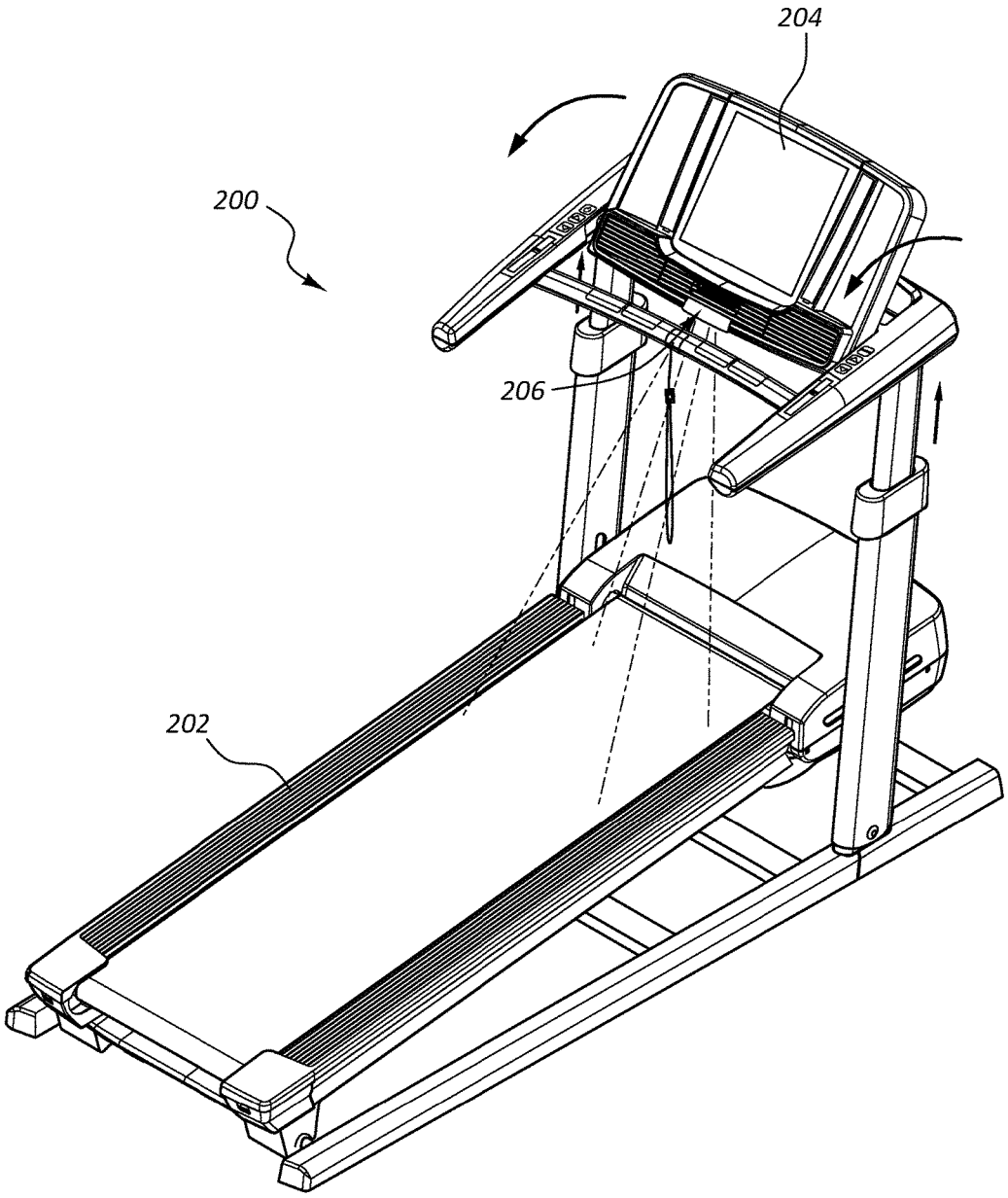
FIG. 2 illustrates a perspective view of an example of a treadmill in an inclined position in accordance with the present disclosure.

FIG. 2 depicts an example of a treadmill 200. In this example, the deck 202 is inclined so that the front portion of the deck 202 is elevated. The console 204 is also moved up and forward. In this example, the sensor 206 incorporated into the console 204 measured that the deck's distance from the console 204 changed. As a result, the sensor sent a signal to a processor that caused the console 204 to move proportionally to the distance that the deck 202 moved.

Figure 3:
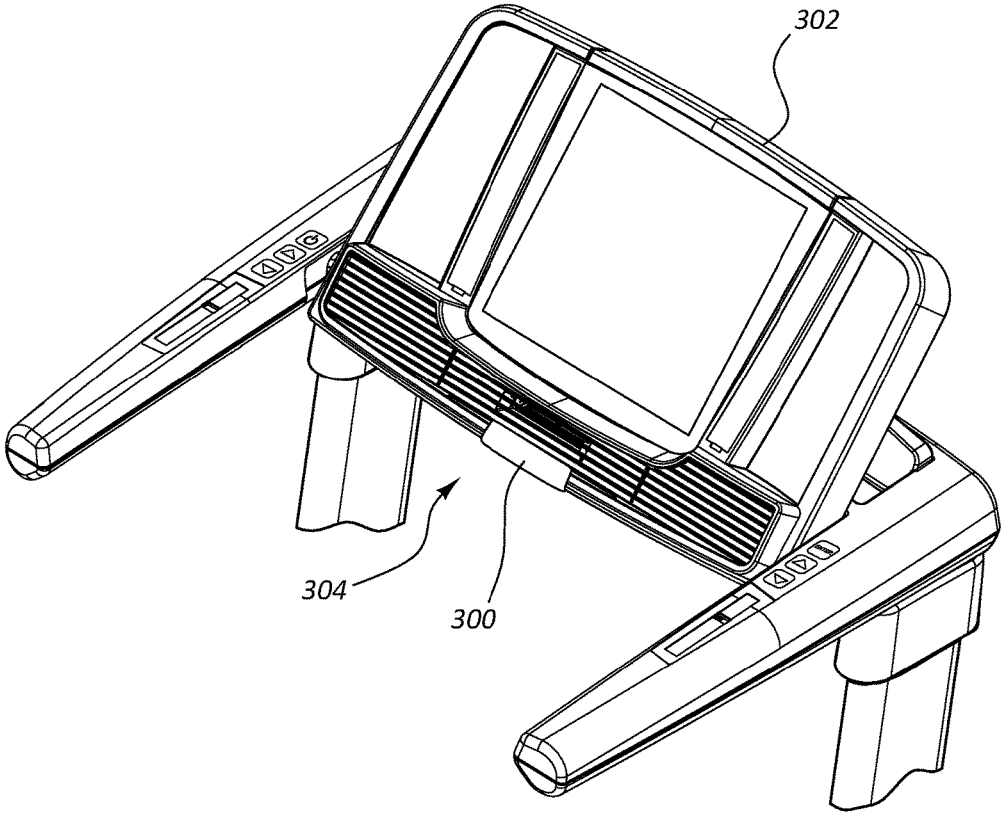
FIG. 3 illustrates a perspective view of an example of a sensor incorporated into a console in accordance with the present disclosure.

FIG. 3 depicts an example of a sensor 300 incorporated into a console 302 of a treadmill. In this example, the sensor 300 is secured to the underside 304 of the console 302. In some cases, the sensor 300 is a camera with an ability to send a signal towards the deck and measure the time that the reflection of the signal takes to return to the sensor 300. This time-of-flight measurement may be recorded by the sensor 300 and sent to a processor that sends directions to actuators to orient the console. In some cases, the processor causes the height of the console to change. In different examples, the processor causes the angle of the console to change. In yet other situations, the processor causes the forward position of the console to change. In an additional example, the processor causes the angle, forward position, and the height of the console 302 to change in response to the time-of-flight measurement.

Figure 4:
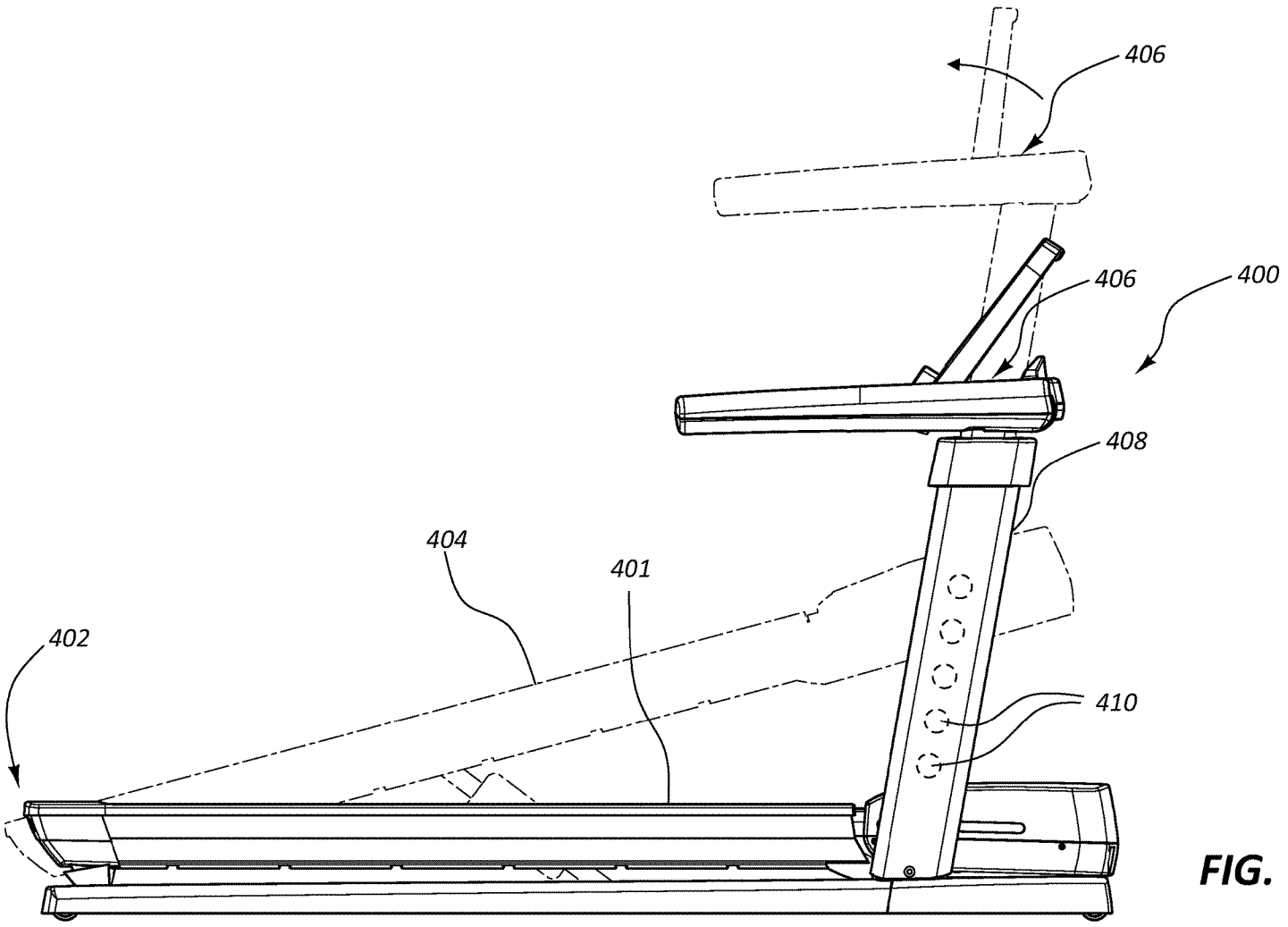
FIG. 4 illustrates a side view of an example of a treadmill in accordance with the present disclosure.

FIG. 4 depicts an example of a treadmill 400 from the side showing the deck 402 in a neutral position 401 in solid lines and showing the deck 402 in an inclined position 404 in dashed lines. The console 406 is moved forward and up when the deck 402 is in the inclined position verses when the deck 402 is in the neutral position.

In this example, at least one of the side posts 408 includes a series of magnetic sensors 410 that are located to sense the incline position of the deck 402. The side of the deck 402 may incorporate a least one magnet (not shown) so that when the deck is moved into a position that is adjacent to one of the magnetic sensors 410, the magnetic sensor 410 can have a signal strength that indicates that the deck 402 is positioned at an angle that is known to the processor. In response, the processor can send a signal to the actuators to change the console's position and orientation based on the deck's orientation.

Figure 5:
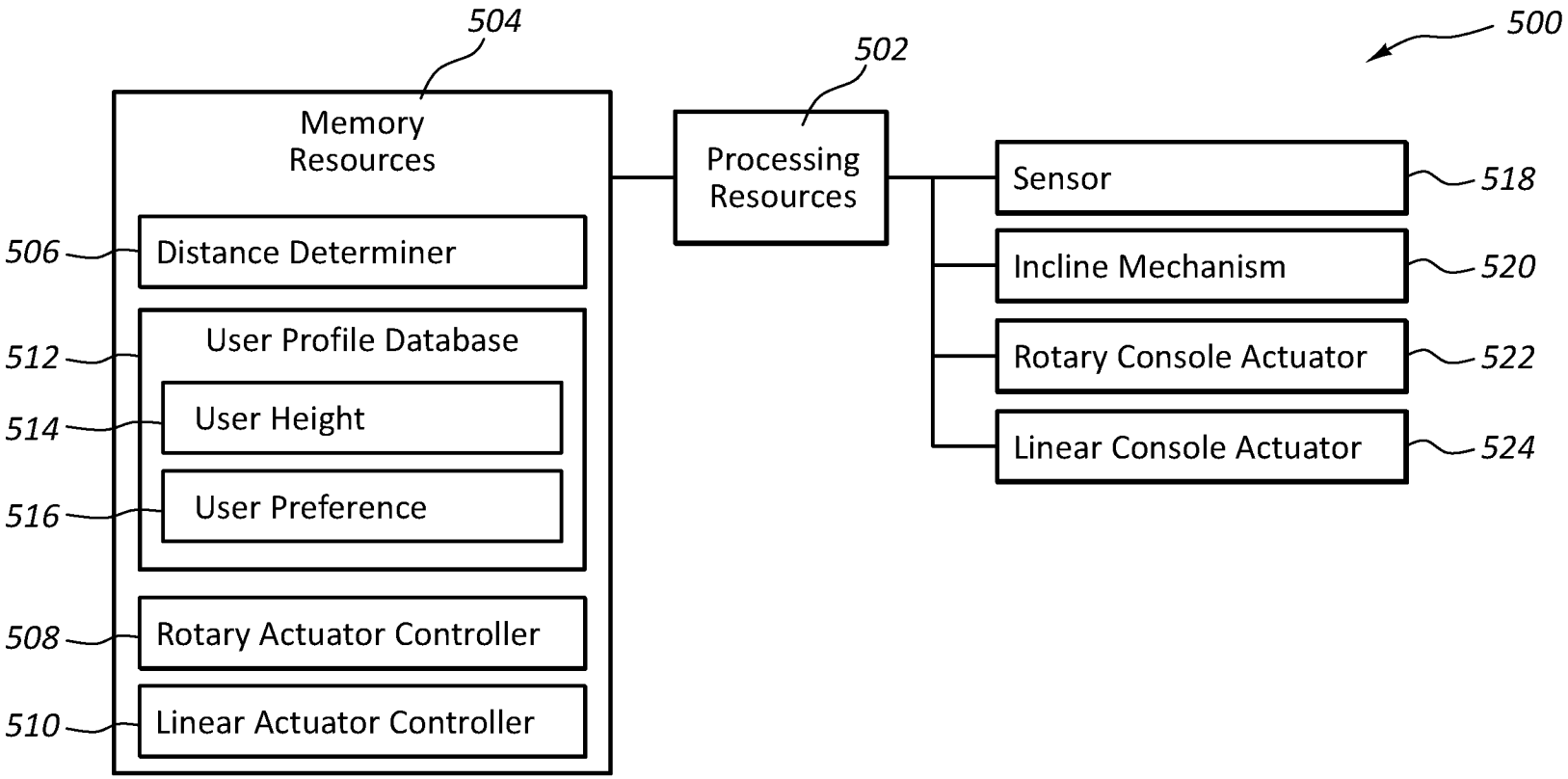
FIG. 5 illustrates a perspective view of an example of an adjusting system in accordance with the present disclosure.

FIG. 5 depicts an example of an adjusting system 500. In this example, the adjusting system 500 includes processing resources 502 and memory resources 504. The memory resources 504 may cause the processing resources 502 to carry out functions programmed in the memory resources 504. In this example, the memory resources 504 include a distance determiner 506, a user profile database 512 that includes a user height 514 and a user preference 516, a rotary actuator controller 508, and a linear actuator controller 510.

The processing resources 502 may be in communication with I/O resources, which may include a receiver, a transmitter, a transceiver, another type of communication device, or combinations thereof. Further, the processing resources 502 may be in direct communication or in communication through the I/O resources with a sensor 518, an incline mechanism 520, a rotary console actuator 522, and a linear console actuator 524.

General Description

In general, the invention disclosed herein may provide users with a treadmill that has a console that can be moved so that the console is at the same relative position to the user regardless of the orientation and/or incline angle of the deck. A sensor may be incorporated into the treadmill that determines where the deck is positioned. With the deck in the new position, the console is moved based on the measurements of the sensor so that the console is in the same relative position to the user as when the deck was in an earlier position.

The exercise deck may include a platform that has a first pulley located in a front portion of the deck and a second pulley located in a rear portion of the deck. A tread belt may surround the first and second pulleys and provide a surface on which the user may exercise. At least one of the first pulley and the second pulley may be connected to a motor so that when the motor is active, the pulley rotates. As the pulley rotates, the tread belt moves as well. The user may exercise by walking, running, or cycling on the tread belt's moving surface. In other examples, the tread belt is moved with the user's own power. In these situations, the tread belt may move as the user pushes off of the tread belt with his or her feet while walking or running A flywheel may be connected to the tread belt and/or one of the pulleys to maintain the tread belt's momentum under the user's power.

The exercise deck may be capable of having its front portion raised and lowered as well as its rear portion raised and lowered to control the lengthwise slope of the running deck. With these elevation controls, the orientation of the running deck can be adjusted as desired by the user or as instructed by a programmed workout. In those examples where the treadmill is involved with simulating a route that involves changes in elevation, the running deck can be oriented to mimic the elevation changes in the route while the user performs an exercise on the deck.

In one example, the lengthwise slope and/or lateral tilt angle of the exercise deck can be controlled with one or more actuators, often linear actuators, positioned at the corners of the deck. In another example, a single linear actuator positioned underneath the deck is attached to the deck's underside and a base of the deck. In this example, when the single linear actuator extends, the single linear actuator increases the incline angle of the deck and when the single linear actuator retracts, the single linear actuator decreases the incline angle of the deck. In yet other examples, multiple actuators are used to adjust the incline angle simultaneously. Other types of actuators may be used, such as cam surfaces, magnets, hydraulic actuators, pneumatic actuators, other types of actuators, or combinations thereof. Thus, in response to determining that the running deck's orientation should change, a signal can be sent to the actuators to appropriately move the deck into the desired orientation. The signal may come from the user's input, a simulated environment, a programmed workout, a remote device, another type of device or program, or combinations thereof.

The treadmill includes a console attached to an upright portion of the treadmill. In some cases, the upright portion includes a first post adjacent to a first side of the deck and a second post adjacent to a second side of the deck. In this example, the console is supported by the first and second deck. The deck moves independently of the first and second posts and also moves independently of the console.

The console may locate a display screen and the treadmill's controls within a convenient reach of the user to control the operating parameters of the exercise deck. For example, the console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the console, monitor the user's heart rate or other physiological parameters during the workout, perform other tasks, or combinations thereof. Buttons, levers, touch screens, voice commands, or other mechanisms may be incorporated into the console and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The treadmill may include preprogrammed workouts that simulate an outdoor route. In other examples, the treadmill has the capability of depicting a real world route. For example, the user may input instructions through the control console, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display to account for changes to the route's location, such as real time weather, recent construction, and so forth. Further, the display may also add simulated features to the display, such as simulated vehicular traffic, simulated flora, simulated fauna, simulated spectators, simulated competitors, or other types of simulated features. While the various types of routes have been described as being presented through the display of the control console, the route may be presented through another type of display, such as a home entertainment system, a nearby television, a mobile device, another type of display, or combinations thereof.

In addition to simulating the route through a visual presentation of a display, the treadmill may also modify the orientation of the running deck to match the inclines and slopes of the route. For example, if the beginning of the simulated route is on an uphill slope, the running deck may be caused to alter its orientation to raise the front portion of the running deck. Likewise, if the beginning of the simulated route is on a downward slope, the rear portion of the running deck may be caused to elevate to simulate the decline in the route. Also, if the route has a lateral tilt angle, the running deck may be tilted laterally to the appropriate side of the running deck to mimic the lateral tilt angle.

While the programmed workout or the simulated environment may send control signals to orient the deck, the user may, in some instances, override these programmed control signals by manually inputting controls through the console. For example, if the programmed workout or the simulated environment cause the deck to be steeper than the user desires, the user can adjust the deck's orientation with the controls in the console.

Any appropriate type of actuator may be used in accordance with the principles described herein. For example, a non-exhaustive list of linear actuators that may be used includes screw actuators, hydraulic actuators, pneumatic actuators, solenoids, magnetic actuators, cams, electro-mechanical actuators, telescoping actuators, other types of linear actuators, other types of actuators, or combinations thereof. Further, the actuators may be powered with a motor, compressed gas, electricity, magnetic fields, other types power sources, or combinations thereof. Further, the actuators may also have the ability to laterally tilt the running deck to any appropriate angle formed between a running surface of the running deck and the surface upon which the treadmill rests. For example, the range of the lateral tilt angle may span from negative 55 degrees to positive 55 degrees or any range there between.

In some examples, the treadmill includes a sensor that measures the distance that the deck is away from the console. This sensor may be in communication with a processor of the console adjusting system. This processor may also control actuators that move the console in response to determining that the distance between the console and the deck has changed. For example, in those situations where the sensor measures that the deck is closer to the console, the actuators move the console farther away from the deck to maintain a predetermined distance between the deck and the console. Similarly, in those situations where the sensor measures that the deck is farther away from the console, the actuators move the console closer from the deck to maintain a predetermined distance between the deck and the console.

The console may be moved by any appropriate mechanism. In some examples, the console is moved with a vertical actuator. The vertical actuator may be positioned to move the console in a vertical direction. The vertical actuator may be linear actuator or another type of actuator. Further, the vertical actuator may include a magnetic mechanism, a rack and pinion, a solenoid, a pneumatic mechanism, a hydraulic mechanism, another type of mechanism, or combinations thereof to cause the console to move. Likewise, the console may be moved with a horizontal actuator that is positioned to move the console in a horizontal direction. This horizontal actuator may be a linear actuator or another type of actuator as listed above.

Further, the console may be tilted into any appropriate orientation based on the position of the deck. In this example, the console may be pivotally connected to the upright portion. In some cases, as the incline angle of the deck increases, the console pivots forward so that the console maintains the same angular orientation with the user. Further, in some examples, when the incline angle decreases, the console pivots downward so that the console maintains the same angular orientation with the user.

In one example, the console is attached to a tray that is connected to the upright structure of the treadmill. In this example, the console can move along a track formed in the tray. In some examples, the tray can also pivot. In this example, the console can move with respect to the tray in a vertical direction and the tray can be rotated in response to the changes in the deck's incline angle.

In another example, the console may be connected to the upright portion through a track in the posts or another portion of the upright structure. In this example, the console is moved along the track in response to changes in the deck's incline angle. The movement along the track may be powered by a motor, a rack and pinion, a linear actuator, another type of actuator, or combinations thereof. The track may be a substantially straight track. In other examples, the track has at least a curved portion.

A distance sensor may be incorporated into the console which detects the distance that the deck is away from the console. In this example, the distance sensor may be a time-of-flight sensor that sends a signal towards the deck and measures the time that it takes for the signal's reflection to return to the sensor. The time-of-flight sensor may be an acoustic sensor, an infrared sensor, a radio frequency sensor, an ultrasonic sensor, a laser sensor, another type of sensor, or combinations thereof.

The distance sensor may be incorporated into any appropriate location of the treadmill. For example, the distance sensor may be incorporated into the underside of the console, the top side of the deck, an upright structure, a frame of the treadmill, another component of the treadmill, or combinations thereof. In some cases, the sensor is an integral feature of the treadmill. In yet other cases, the sensor is attachable to the outside of the treadmill.

The distance sensor may be continuously monitoring the distance between the console and the deck. In other examples, the distance sensor takes a measurement of the distance between the deck and the console at predetermined intervals. In yet other examples, the sensor takes a measurement when triggered by an appropriate event. An incline mechanism may send a signal to the processor when the incline mechanism is about to move, is currently moving, or has finished changing the incline angle of the deck. In response to receiving the signal from the incline mechanism, the processor can send instructions to the distance sensor to take a distance measurement. In response to determining the change in the distance, the processor can instruct the actuators that cause the console to move to make an adjustment.

In another example, the sensor is incorporated into the posts of the upright structure. As the front portion of the deck moves with respect to the posts based on the deck's incline angle, the sensor in the posts can determine the location of the deck and send the location information to the processor. For example, a series of magnetic sensors may be positioned along a portion of the posts' length. One of the magnetic sensors may be located in the neutral position so that the magnetic sensor senses that the deck is adjacent to the neutral magnetic sensor when the deck is in the neutral position. An object with a recognizable magnetic field may be incorporated into the deck so that the magnetic sensors can detect the presence of the deck when the deck is adjacent to the magnetic sensors. In one example, the object incorporated into the deck may be a magnet with a strong enough magnetic field strength that the magnetic sensor can detect the object's presence and therefore detect the presence of the deck. In another example, the object has an identifiable magnetic signature that allows the magnetic sensor to distinguish the presence of the object incorporated in the deck from other items that have a magnetic field.

In one situation, the deck may be inclined so that the front portion of the deck moves to be adjacent to a magnetic sensor located above the neutral sensor. In at least one instance, the deck may be moved so that the front portion of the deck is located adjacent to a third or fourth magnetic sensor that is located above the neutral magnet. In another example, the deck may be declined so that the magnetic sensors located below the neutral magnetic sensor detect that the front portion of the deck is located proximate to them. Depending on the location of the deck, one or more of the magnetic sensors may indicate that the deck is located proximate to the deck. While this example has been described with magnetic sensors incorporated into the upright structure to determine whether the front portion of the deck is adjacent, any appropriate type of sensor may be used. For example, the sensors incorporated into the upright structure may include optical sensors, time-of-flight sensors, push sensors, level sensors, other types of sensors, or combinations thereof.

In another example, the sensor is an optical sensor that may be incorporated into the console, incorporated into the upright structure of the console, incorporated into the deck, incorporated into another portion of the treadmill, or combinations thereof. The optical sensor may be positioned so that the deck is in the optical sensor's field of view. The optical sensor may include a position that the optical sensor understands to be a neutral baseline and when the deck is aligned with the neutral baseline, the optical sensor determines that the deck is in a neutral position. When the deck is angularly offset from the neutral baseline, the optical sensor can measure the angular offset to determine the deck's incline angle.

The console may move at the same time that the deck moves. In this example, the console is continuously adjusted in real time for the changes in the deck's incline angle. In other examples, the console moves after a delay after changing the deck's incline angle. In some situations, the console can be moved to one of multiple preset locations and/or preset angular orientations. In yet other situations, the console can be moved to any position or angular orientation within the ranges that the console can move.

According to one embodiment, once the relative distance between the sensor and the deck is detected, the angular position of the deck is also determined, and the console may move less than the sensed difference, depending on the angle of the deck. When the deck is oriented at extreme angles, the user contacts the deck at a lower relative position of the deck than the portion of the deck directly under the console. In order to compensate for the lower position, the adjusted height of the console may less than the original height of the console relative to the deck in a horizontal position.

The adjusting system for changing the position and/or orientation of the console may include a combination of hardware and programmed instructions for executing the functions of the adjusting system. The adjusting system may include processing resources that are in communication with memory resources. Processing resources include at least one processor and other resources used to process the programmed instructions. As described herein, the memory resources may represent generally any memory capable of storing data such as programmed instructions or data structures used by the adjusting system.

The processing resources may include I/O resources that are capable of being in communication with a remote device that stores the user information, user preferences, programmed workouts, simulated workouts, other types of information, or combinations thereof. The remote device may be a mobile device, a cloud based device, a computing device, another type of device, or combinations thereof. In some examples, the adjusting system communicates with the remote device through a mobile device which relays communications between the adjusting system and the remote device.

The remote device may execute a program that can provide useful information to the adjusting system. An example of a program that may be compatible with the principles described herein includes the iFit program which is available through www.ifit.com identified above. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources include a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the actuation system through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The memory resources may include a distance determiner that represents programmed instructions that, when executed, cause the processing resources to determine the distance that the console is from the deck. The distance determiner may determine the distance based on a measurement from the sensor. In another example, the adjusting system uses another mechanism for determining the distance of the deck from the console.

The memory resources may also include a profile user database that includes information about the user that affects the position and/or orientation of the console. In some examples, the profile user database includes a user height, a user preference, another characteristic about the user, or combinations thereof.

In some examples, the memory resources include a rotary actuator controller that represents programmed instructions that, when executed, cause a rotary console actuator to rotate the orientation of the console so that the console maintains a relative angle with the user despite a change in the deck's incline angle. Further, the memory resources may include a linear actuator controller that represents programmed instructions that, when executed, cause a linear console actuator to move the console in a linear direction based on the incline angle of the deck. In some cases, the linear direction includes a vertical direction, a horizontal direction, a diagonal direction, another type of direction, or combinations thereof.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, a mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

While the examples above have been described with reference to changing the position and/or orientation of the console based on the incline angle of the deck, any appropriate parameter of the deck may be used to trigger a change in the console's position and/or orientation. For example, changing the position and/or orientation of the console may be triggered by changing the side to side tilt of the deck, the overall height of the deck, another parameter of the deck, or combinations thereof.

In some cases, the incline mechanism sends instructions to the console to move the position and/or orientation of the console based on the changes in the deck's incline angle. In this situation, the sensor may confirm the distance between the deck and the console. In this type of example, the actuators that move the console may be triggered to move the console in response to receiving the confirmation.

While the examples above have been described applying to a treadmill, the principles described herein may be applicable to any appropriate exercise machine. For example, the exercise machine may be a treadmill, an elliptical strider, a stationary bicycle, a rowing machine, a stepper machine, another type of machine, or combinations thereof.

What is claimed is:

1. An exercise device, comprising:
a frame;
a console movably attached to the frame;
a sensor associated with the exercise device;
memory and a processor;
the memory including programmed instructions that, when executed, cause the processor to:
automatically measure, with the sensor, a distance between the console and a portion of the frame at predetermined intervals; and
adjust a position of the console based on the measurement.

2. The exercise device of claim 1, wherein the position is an angle of the console with respect to a user.

3. The exercise device of claim 1, wherein the position is height position.

4. The exercise device of claim 1, wherein the sensor is connected the console.

5. The exercise device of claim 1, wherein the sensor is connected to the portion of the frame.

6. The exercise device of claim 1, wherein the sensor is a time-of-flight sensor.

7. The exercise device of claim 1, wherein the sensor is an optical sensor configured to measure an angular position of the portion of the frame relative to a neutral baseline.

8. The exercise device of claim 1, wherein the sensor is a magnetic sensor located in a side post of the frame.

9. The exercise device of claim 1, further including:
an exercise deck;
wherein the portion of the frame is incorporated into the exercise deck.

10. The exercise device of claim 9, further including:
an incline mechanism that adjusts an orientation of the exercise deck; and
wherein the programmed instructions further, when executed, cause the processor to measure the distance between the console and the portion of the frame incorporated into the exercise deck in response to the incline mechanism adjusting the orientation.

11. The exercise device of claim 1, wherein the programmed instructions, when executed, further cause the memory to store a user profile.

12. The exercise device of claim 11, wherein the programmed instructions, when executed, further cause the processor to change a console height in response to information in the user profile.

13. The exercise device of claim 1, wherein the exercise device comprises a treadmill.

14. A treadmill, comprising:
an upright structure;
an exercise deck independently movable of the upright structure;
a console movably attached to the upright structure;
a sensor connected to the treadmill;
an incline mechanism that adjusts an orientation of the exercise deck; and
memory and a processor;
the memory including programmed instructions that, when executed, cause the processor to:
measure a first distance between the console and the exercise deck with the sensor in response to the incline mechanism adjusting the orientation;
measure a second distance between the console and the exercise deck with the sensor;
determine a difference between the first distance and the second distance; and
adjust a position of the console based on the difference.

15. The treadmill of claim 14, wherein the programmed instructions, when executed, further cause the memory to store a user profile.

16. The treadmill of claim 15, wherein the programmed instructions, when executed, further cause the processor to change a console height in response to information in the user profile.

17. The treadmill of claim 14, wherein the sensor is connected to the console.

18. The treadmill of claim 14, wherein the sensor is connected to the exercise deck.

19. The treadmill of claim 14, wherein the sensor is a time-of-flight sensor.

20. A treadmill, comprising:
an upright structure;
an exercise deck independently movable of the upright structure;
a console movably attached to the upright structure;
a time-of-flight sensor connected to the console;
an incline mechanism that adjusts an angular orientation of the exercise deck; and
memory and a processor;
the memory including programmed instructions that, when executed, cause the processor to:
measure a distance between the console and the exercise deck with the time-of-flight sensor in response to the incline mechanism adjusting the orientation;
determine the angular position of the exercise deck; and
adjust a position of the console based on the measurement and the angular orientation, wherein the position of the console is maintained relative to a user.

* * * * *